US011976577B2

(12) United States Patent
Andrisani et al.

(10) Patent No.: US 11,976,577 B2
(45) Date of Patent: May 7, 2024

(54) VALVE TRAIN ASSEMBLY

(71) Applicant: EATON INTELLIGENT POWER LIMITED, Dublin (IE)

(72) Inventors: Nicola Andrisani, Cumiana (IT); Fabiano Contarin, Rivarolo Canavese (IT); Emanuele Raimondi, San Francesco Al Campo (IT); Majo Cecur, Rivarolo Canavese (IT); Alessio Lorenzon, Avigliana (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/306,972

(22) Filed: May 4, 2021

(65) Prior Publication Data

US 2021/0254512 A1 Aug. 19, 2021

Related U.S. Application Data

(62) Division of application No. 16/094,492, filed as application No. PCT/EP2017/059520 on Apr. 21, 2017, now Pat. No. 11,028,736.

(30) Foreign Application Priority Data

Apr. 21, 2016 (GB) ..... 1606950
Mar. 9, 2017 (GB) ..... 1703795

(51) Int. Cl.
*F01L 1/18* (2006.01)
*F01L 1/08* (2006.01)
(Continued)

(52) U.S. Cl.
CPC ..... *F01L 1/18* (2013.01); *F01L 1/08* (2013.01); *F01L 1/2422* (2013.01);
(Continued)

(58) Field of Classification Search
CPC ... F01L 1/18; F01L 1/08; F01L 1/2422; F01L 1/46; F01L 1/047; F01L 2001/186; F01L 2001/2433; F01L 13/0005; F01L 2013/001
(Continued)

(56) References Cited

U.S. PATENT DOCUMENTS 4,762,096 A * 8/1988 Kamm ..... F01L 13/0036 123/90.43
5,203,289 A 4/1993 Hara et al.
(Continued)

FOREIGN PATENT DOCUMENTS

CN 101086212 A 12/2007
CN 104271902 A 1/2015
(Continued)

*Primary Examiner* — Kenneth J Hansen
*Assistant Examiner* — Kelsey L Stanek
(74) *Attorney, Agent, or Firm* — Baker Botts L.L.P.

(57) ABSTRACT

A valve train assembly for an internal combustion engine includes: a dual body rocker arm for controlling a valve of a cylinder, the rocker arm including a first body, a second body mounted for pivotal motion with respect to the first body, a first biasing means, and a latch pin moveable between a first position in which the latch pin latches the first body and the second body together and a second position in which the first body and the second body are un-latched to allow pivotal motion of the second body relative to the first body; and an actuator arrangement external to the dual body rocker arm and drivable by an actuation source, the actuator arrangement moving the latch pin from one of the first position and the second position to the other of the first position to the second position.

33 Claims, 14 Drawing Sheets

(51) Int. Cl.
*F01L 1/24* (2006.01)
*F01L 13/00* (2006.01)

(52) U.S. Cl.
CPC ..... *F01L 13/0005* (2013.01); *F01L 2001/186* (2013.01); *F01L 2001/2433* (2013.01); *F01L 2013/001* (2013.01)

(58) Field of Classification Search
USPC ..... 123/90.16
See application file for complete search history.

(56) References Cited

U.S. PATENT DOCUMENTS

| | | | | |
|---|---|---|---|---|
| 5,619,958 | A | 4/1997 | Hampton et al. | |
| 5,653,198 | A * | 8/1997 | Diggs | F01L 13/0005 123/90.16 |
| 6,314,928 | B1 | 11/2001 | Baraszu et al. | |
| 6,499,451 | B1 * | 12/2002 | Hendriksma | F01L 1/08 123/90.38 |
| 7,621,242 | B2 | 11/2009 | Hirano et al. | |
| 7,761,217 | B2 | 7/2010 | Waters et al. | |
| 2013/0255612 | A1 | 10/2013 | Zurface et al. | |
| 2013/0306013 | A1 | 11/2013 | Genise et al. | |
| 2014/0190431 | A1 | 7/2014 | McCarthy, Jr. | |
| 2015/0047586 | A1 * | 2/2015 | Nowak | F01L 1/34 123/90.15 |
| 2015/0047589 | A1 | 2/2015 | Kemmer et al. | |
| 2015/0128890 | A1 * | 5/2015 | Cecur | F01L 13/0047 123/90.16 |
| 2016/0138435 | A1 * | 5/2016 | Zurface | F01L 13/0036 123/90.16 |
| 2017/0198613 | A1 * | 7/2017 | Raimondi | F01L 1/34 |
| 2018/0363518 | A1 * | 12/2018 | Raimondi | F01L 13/0036 |

FOREIGN PATENT DOCUMENTS

| | | | | |
|---|---|---|---|---|
| CN | 104321503 | A | 1/2015 | |
| CN | 204082242 | U | 1/2015 | |
| CN | 204804892 | U | 11/2015 | |
| CN | 105378236 | A | 3/2016 | |
| EP | 2653673 | A1 | 10/2013 | |
| EP | 2806118 | A1 | 11/2014 | |
| GB | 2526554 | A * | 12/2015 | F01L 1/047 |
| GB | 2526554 | A | 12/2015 | |
| JP | 2003343227 | A | 12/2003 | |
| JP | 4516552 | B2 | 8/2010 | |

* cited by examiner

VALVE TRAIN ASSEMBLY

CROSS-REFERENCE TO RELATED APPLICATIONS

This application is a divisional of U.S. patent application Ser. No. 16/094,492, filed on Oct. 18, 2018 and issued as U.S. Pat. No. 11,028,736 on Jun. 8, 2021, which is a U.S. National Phase application under 35 U.S.C. § 371 of International Application No. PCT/EP2017/059520, filed on Apr. 21, 2017, which claims benefit to British Patent Application No. GB 1606950.2, filed on Apr. 21, 2016 and British Patent Application No. GB 1703795.3, filed on Mar. 9, 2017. The International Application was published in English on Oct. 26, 2017 as WO 2017/182631 under PCT Article 21(2). The entire disclosures of the foregoing applications are hereby incorporated by reference herein.

FIELD

The present invention relates to valve train assemblies of internal combustion engines, specifically to actuation of switchable engine or valve train components of a valve train assembly.

BACKGROUND

Internal combustion engines may comprise switchable engine or valve train components. For example, valve train assemblies may comprise a switchable rocker arm to provide for control of valve actuation (for example exhaust valve actuation and/or de-actuation) by alternating between at least two or more modes of operation (e.g. valve-lift modes). Such rocker arms typically involve multiple bodies, such as an inner arm and an outer arm. These bodies are latched together to provide one mode of operation (e.g. a first valve-lift mode) and are unlatched, and hence can pivot with respect to each other, to provide a second mode of operation (e.g. a second valve-lift mode). Typically, a moveable latch pin is used and actuated and de-actuated to switch between the two modes of operation.

SUMMARY

In an embodiment, the present invention provides a valve train assembly for an internal combustion engine, the valve train assembly comprising: a dual body rocker arm configured to control a valve of a cylinder, the rocker arm comprising a first body, a second body mounted for pivotal motion with respect to the first body, a first biasing means, and a latch pin moveable between a first position in which the latch pin latches the first body and the second body together and a second position in which the first body and the second body are un-latched to allow pivotal motion of the second body relative to the first body; and an actuator arrangement external to the dual body rocker arm and drivable by an actuation source, the actuator arrangement for moving the latch pin from one of the first position and the second position to the other of the first position to the second position; wherein, in use, the first biasing means becomes biased by the actuator arrangement when the actuation source drives the actuator arrangement when the actuation source attempts to move the latch pin from one of the first position and the second position to the other of the first position and the second position, via the actuator arrangement, when the dual body rocker arm is in an un-activatable state in which the latch pin is non-moveable, whereby the first biasing means causes the latch pin to move from the one of the first position and the second position to the other of the first position to the second position when the dual body rocker arm is in an activatable state in which the latch pin is moveable again.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1A:
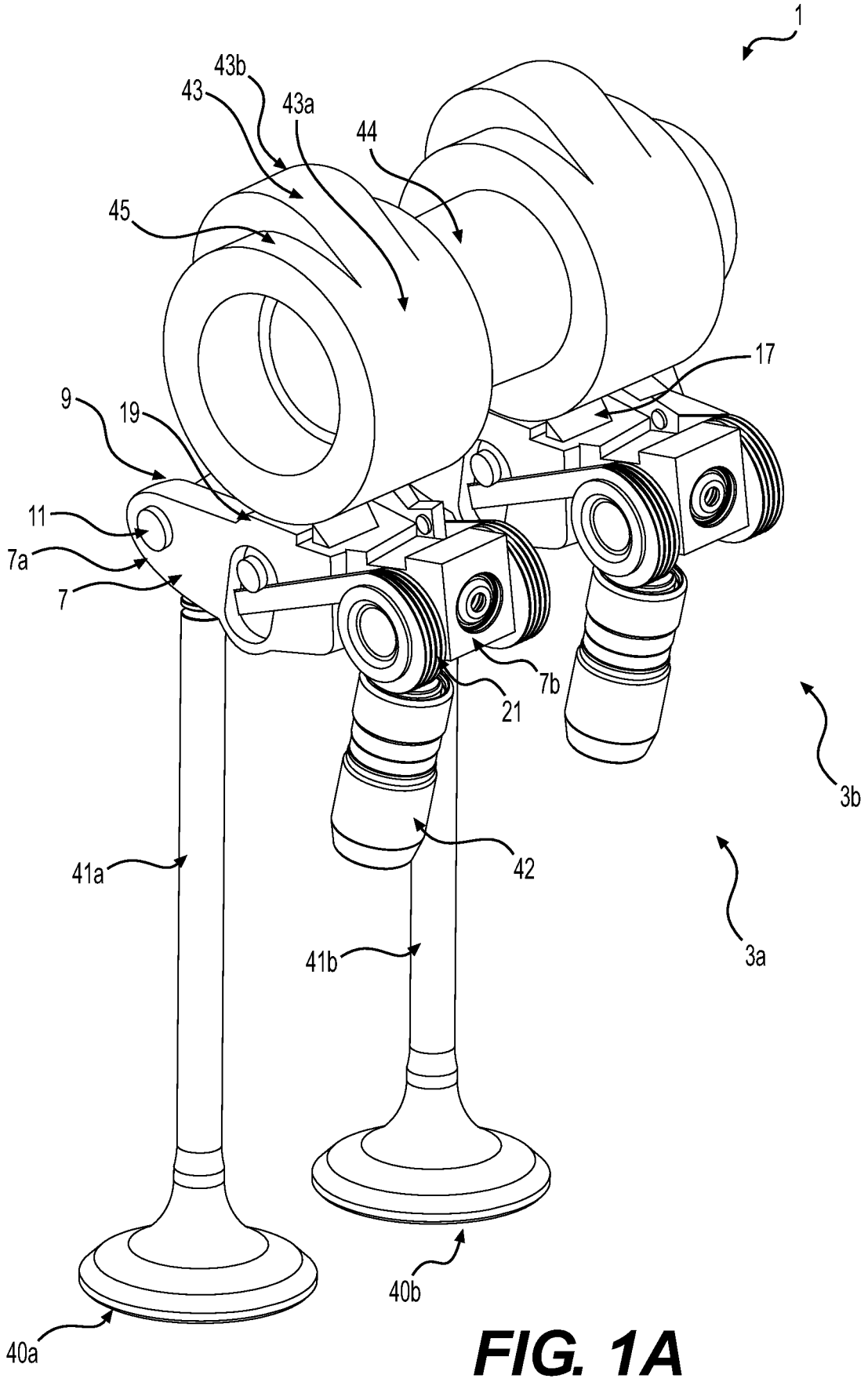
FIG. 1*a* illustrates schematically a perspective view of a portion of valve train assembly according to an example.

According to a first aspect of the invention there is provided a valve train assembly comprising a first group of one or more dual body rocker arms and a second group of one or more dual body rocker arms, wherein the first group is for controlling one or more valves of a first cylinder and the second group is for controlling one or more valves of a second cylinder, wherein each of the dual body rocker arms comprises a first body, a second body, and a latching arrangement for latching and unlatching the first body and the second body, the assembly further comprising an actuator arrangement external to the dual body rocker arms for controlling the latching arrangement and wherein the actuator arrangement comprises a shaft comprising a first set of one or more cams for controlling the latching arrangements of the first group of one or more dual body rocker arms and a second set of one or more cams for controlling the latching arrangements of the second group of one or more dual body rocker arms and wherein the shapes of the cams of the first set of one or more cams is different to the shapes of the cams of the second set of one or more cams to provide for controlling the latching arrangements on a per cylinder basis.

Each cam may comprises one or more lobed portions for applying a force to the latching arrangement of the respective rocker arm.

The cams of the first set of one or more cams may comprise two said lobed portions arranged substantially at right angles to one another about a rotational axis of the shaft.

The cams of the second set of one or more cams may comprise two said lobed portions arranged substantially opposite one another about a rotational axis of the shaft.

The lobed portions of the cams of the second set of one or more cams may be substantially parallel to one of the two lobed portions of the cams of the second set of one or more cams.

The valve train assembly may comprise an actuation source arranged to rotate the shaft.

The actuation source may be an electric motor.

The valve train assembly may comprise a controller arranged to control the rotation of the actuation source thereby to control rotation of the shaft.

The controller may be arranged to control the rotational orientation of the shaft such that both, one of, or neither of the first set of one or more cams and second set of one or more cams apply a force to the latching arrangements of the respective dual body rocker arms.

The first group may comprise at least two said dual body rocker arms each for controlling a respective valve of the first cylinder, and the second group may comprise at least two said dual body rocker arms each for controlling a respective valve of the second cylinder.

The first group may further comprise one or more said dual body rocker arms for controlling one or more said valves of one or more further cylinders, and/or the second group may further comprise one or more said dual body rocker arms for controlling one or more said valves of one or more further cylinders.

The dual body rocker arms of the first group may be for controlling one half, one third, or two thirds of said valves of said cylinders.

The first group may comprise one or more said dual body rocker arms for controlling one or more said valves of a third cylinder, and the second group may comprise one or more said dual body rocker arms for controlling one or more said valves of a fourth cylinder.

The valve train assembly may be arranged such that the first group and the second group control alternate cylinders.

The first group may comprise one or more said dual body rocker arms for controlling one or more said valves of a fifth cylinder, and the second group may comprise one or more said dual body rocker arms for controlling one or more said valves of a sixth cylinder.

The valve train assembly may be arranged for said first to sixth cylinders arranged in an order such that the first, third and fifth cylinders controlled by the first group are consecutive to the second, fourth, and sixth cylinders controlled by the second group.

Each of the rocker arms may be arranged such that, when the first body and the second body are un-latched, cylinder deactivation is provided.

The valves may be exhaust valves.

The second body may be mounted for pivotal motion with respect to the first body.

The latching arrangement may comprise a latch pin moveable between a first position in which the first body and the second body are latched together and a second position in which the first body and the second body are un-latched.

The cams may be for moving the latch pins from one of the first position and the second position and the other of the first position and the second position.

The cams may be arranged to move the latch pins from the second position to the first position.

The latch pin may be slidably disposed in a latch pin channel of the dual body rocker arm.

The latch pin channel may be formed in the first body.

The latch pin channel may be formed in the first body at a first end of the first body, and the first end of the first body may further define a first contact region for contacting a hydraulic lash adjuster.

A second end of the first body opposite the first end may comprise a second contact region for contacting a stem of a said valve.

Each of the rocker arms may further comprise a first biasing means for biasing the latch pin to the one of the first and second positions.

The first biasing means may bias the latch pin to the second position, and the cam may move the latch pin from the second position to the first position against the biasing means.

Each dual body rocker arm may further comprise a second biasing means, and the second biasing means may be arranged such that, in use, the second biasing means becomes biased by the actuator arrangement when a or the actuation source drives the actuator arrangement when the actuation source attempts to move the latch pin from one of the first position and the second position to the other of the first position and the second position, via the actuator arrangement, when the dual body rocker arm is in an un-activatable state in which the latch pin is non-moveable, whereby the second biasing means causes the latch pin to move from the one of the first position and the second position to the other of the first position to the second position when the dual body rocker arm is in an activatable state in which the latch pin is moveable again.

The second biasing means may be a leaf spring.

According to a second aspect of the present invention, there is provided a valve train assembly for an internal combustion engine, the valve train assembly comprising:

a dual body rocker arm for controlling a valve of a cylinder, the rocker arm comprising a first body, a second body mounted for pivotal motion with respect to the first body, a first biasing means, and a latch pin moveable between a first position in which the latch pin latches the first body and the second body together and a second position in which the first body and the second body are un-latched to allow pivotal motion of the second body relative to the first body; and an actuator arrangement external to the dual body rocker arm and drivable by an actuation source, the actuator arrangement for moving the latch pin from one of the first position and the second position to the other of the first position to the second position;

wherein, in use, the first biasing means becomes biased by the actuator arrangement when the actuation source drives the actuator arrangement when the actuation source attempts to move the latch pin from one of the first position and the second position to the other of the first position and the second position, via the actuator arrangement, when the dual body rocker arm is in an un-activatable state in which the latch pin is non-moveable, whereby the first biasing means causes the latch pin to move from the one of the first position and the second position to the other of the first position to the second position when the dual body rocker arm is in an activatable state in which the latch pin is moveable again.

When the dual body rocker arm is in the activatable state, the actuation source driving the actuator arrangement may cause the latch pin to move from the one of the first position and the second position to the other of the first position to the second position immediately.

The actuator arrangement may be for moving the latch pin from the second position to the first position, and the first biasing means may be arranged such that, in use, the first biasing means becomes biased by the actuator arrangement when the actuation source drives the actuator arrangement when the actuation source attempts to move the latch pin from the second position to the first position, via the actuator arrangement, when the dual body rocker arm is in the un-activatable state, whereby the first biasing means causes the latch pin to move from the second position to the first position when the dual body rocker arm is in the activatable state again.

The dual body rocker arm may comprise a second biasing means arranged to bias the latch pin towards the second position.

The first biasing means may be a leaf spring.

A first end of the leaf spring may be attached to the latch pin.

A second end of the leaf spring may be for contacting the actuation arrangement.

The leaf spring may be substantially external of the dual body rocker arm.

The actuation arrangement may comprise a shaft rotatable by the actuation source and which may comprise a cam for contacting the dual body rocker arm.

The cam may comprise a lobed profile for contacting the leaf spring.

The leaf spring may be arranged such that, in use, the leaf spring becomes compressed by the lobed profile of the cam when the actuation source rotates the shaft when the actuation source attempts to move the latch pin from the second position to the first position, via the cam, when the dual body rocker arm is in the un-activatable state, whereby the leaf spring expands and thereby causes the latch pin to move from the second position to the first position when the dual body rocker arm is in the activatable state again.

The valve train assembly may comprise the actuation source.

The actuation source may be an electric motor.

According to a third aspect of the present invention, there is provided a valve train assembly comprising a first group of one or more dual body rocker arms and a second group of one or more dual body rocker arms, wherein the first group is for controlling one or more valves of a first cylinder and the second group is for controlling one or more valves of a second cylinder, wherein each of the dual body rocker arms comprise a first body, a second body mounted for pivotal motion with respect to the first body, and a latch pin moveable between a first position in which the first body and the second body are latched together and a second position in which the first body and the second body are un-latched, wherein the valve train assembly further comprises a first hydraulic fluid supply for supplying hydraulic fluid to the one or more dual body rocker arms of the first group in order to move the respective latch pins of the one or more dual body rocker arms of the first group from one of the first and second positions to the other of the first and second positions, wherein the valve train assembly further comprises a second separate hydraulic fluid supply for supplying hydraulic fluid to the one or more dual body rocker arms of the second group in order to move the respective latch pins of the one or more dual body rocker arms of the second group from one of the first and second positions to the other of the first and second positions, wherein the first hydraulic fluid supply is controllable independently of the second hydraulic fluid supply, thereby to provide for controlling the latch pins on a per cylinder basis.

The valve train assembly may further comprise a plurality of hydraulic lash adjusters each comprising a conduit for transferring hydraulic fluid from a said hydraulic fluid supply to a respective one of the dual body rocker arms in order to move the latch pin of the respective one of the dual body rocker arms from one of the first and second positions to the other of the first and second positions.

The latch pin of each rocker arm may be slidably disposed in a latch pin channel, wherein the latch pin channel is in fluid communication with the conduit of the hydraulic lash adjuster for the respective rocker arm to receive hydraulic fluid from the hydraulic fluid supply for the respective rocker arm in order to move the latch pin from the one of the first and second positions to the other of the first and second positions.

The latch pin channel may be formed in the first body.

The latch pin channel may be formed in the first body at a first end of the first body, and the first end of the first body may further define a first contact region for contacting the hydraulic lash adjuster.

A second opposite end of the first body may comprise a second contact region for contacting a stem of a said valve.

Each of the rocker arms may further comprise a biasing means for biasing the latch pin to the one of the first and second positions.

The biasing means may bias the latch pin to the first position, and each rocker arm may be arranged such that the supply of hydraulic fluid from the hydraulic fluid supply for the respective rocker arm moves the latch pin from the first position to the second position against the biasing means.

The biasing means may be located internally of the first body.

The second body may comprise a roller for engaging a cam profile.

Each of the rocker arms may be arranged such that, when the first body and the second body are un-latched, cylinder deactivation is provided.

The valve train assembly may further comprise a first hydraulic fluid control valve to control the supply of hydraulic fluid in the first hydraulic fluid supply and a second hydraulic fluid control valve to control the supply of hydraulic fluid in the second hydraulic fluid supply.

Each hydraulic fluid control valve may be controllable to increase a pressure of hydraulic fluid in the respective hydraulic fluid supply, and may be controllable to decrease a pressure of hydraulic fluid in the respective hydraulic fluid supply.

The valve train assembly may further comprise a controller arranged to control the first hydraulic fluid control valve and the second hydraulic fluid control valve.

The controller may be arranged to control the hydraulic fluid control valves so as to supply hydraulic fluid to both, one of, or neither of the first and second hydraulic fluid supply.

The first group may comprise at least two said dual body rocker arms each for controlling a respective valve of the first cylinder, and the second group may comprise at least two said dual body rocker arms each for controlling a respective valve of the second cylinder.

The first group may further comprise one or more said dual body rocker arms for controlling one or more said valves of one or more further cylinders, and/or the second group may further comprise one or more said dual body rocker arms for controlling one or more said valves of one or more further cylinders.

The dual body rocker arms of the first group may be for controlling one half, one third, or two thirds of said valves of said cylinders.

The first group may comprise one or more said dual body rocker arms for controlling one or more said valves of a third cylinder, and the second group may comprise one or more said dual body rocker arms for controlling one or more said valves of a fourth cylinder.

The valve train assembly may be arranged for said first to fourth cylinders arranged in an order such that the first and third cylinders controlled by the first group are consecutive to the second and fourth cylinders controlled by the second group.

The first group may comprise one or more said dual body rocker arms for controlling one or more said valves of a fifth cylinder, and the second group may comprise one or more said dual body rocker arms for controlling one or more said valves of a sixth cylinder.

The valve train assembly may be arranged for said first to sixth cylinders arranged in an order such that the first, third and fifth cylinders controlled by the first group are consecutive to the second, fourth, and sixth cylinders controlled by the second group.

The valves may be exhaust valves.

Figure 1B:
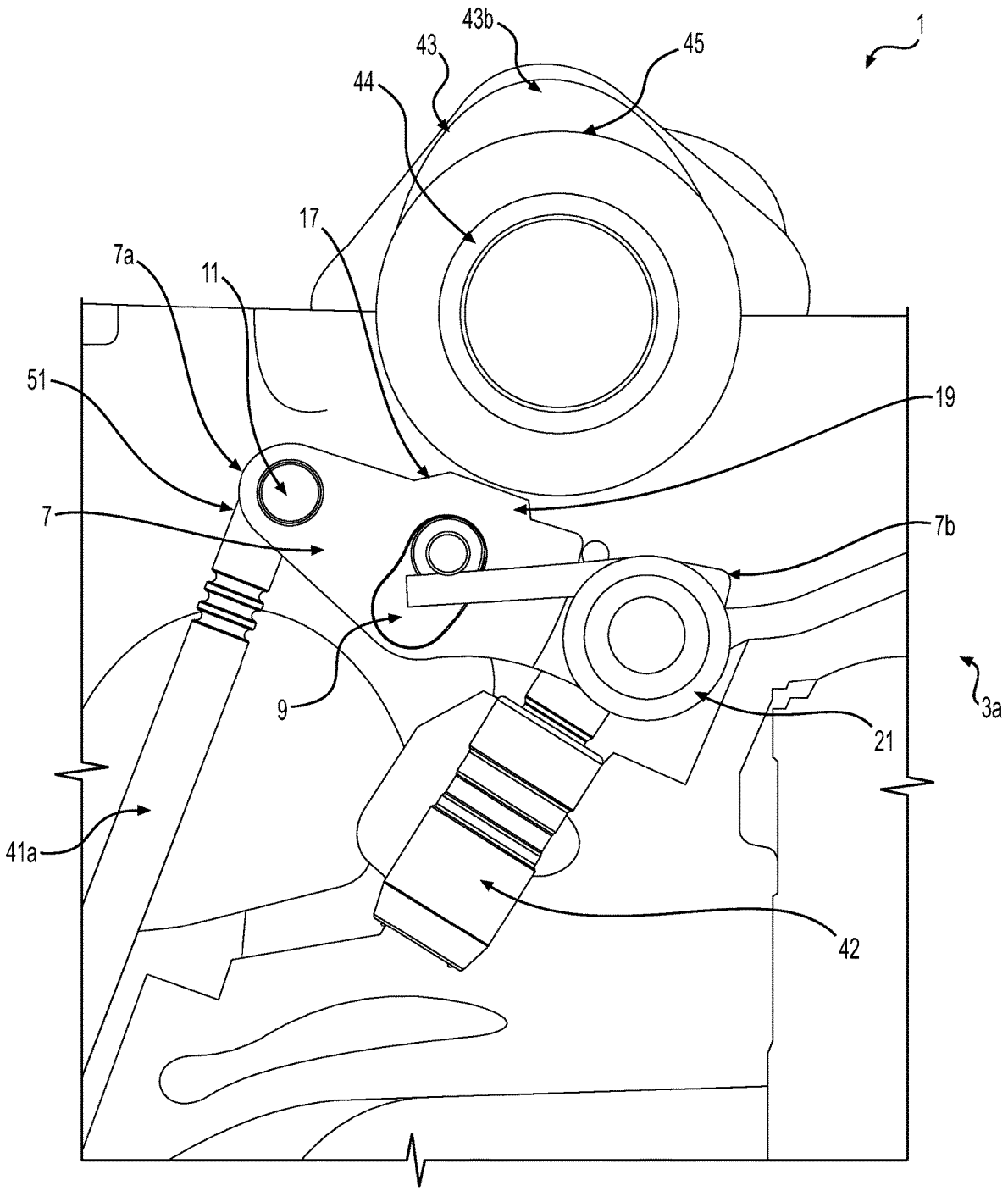
FIG. 1*b* illustrates schematically a cross section of the valve train assembly of FIG. 1.
Figure 1C:
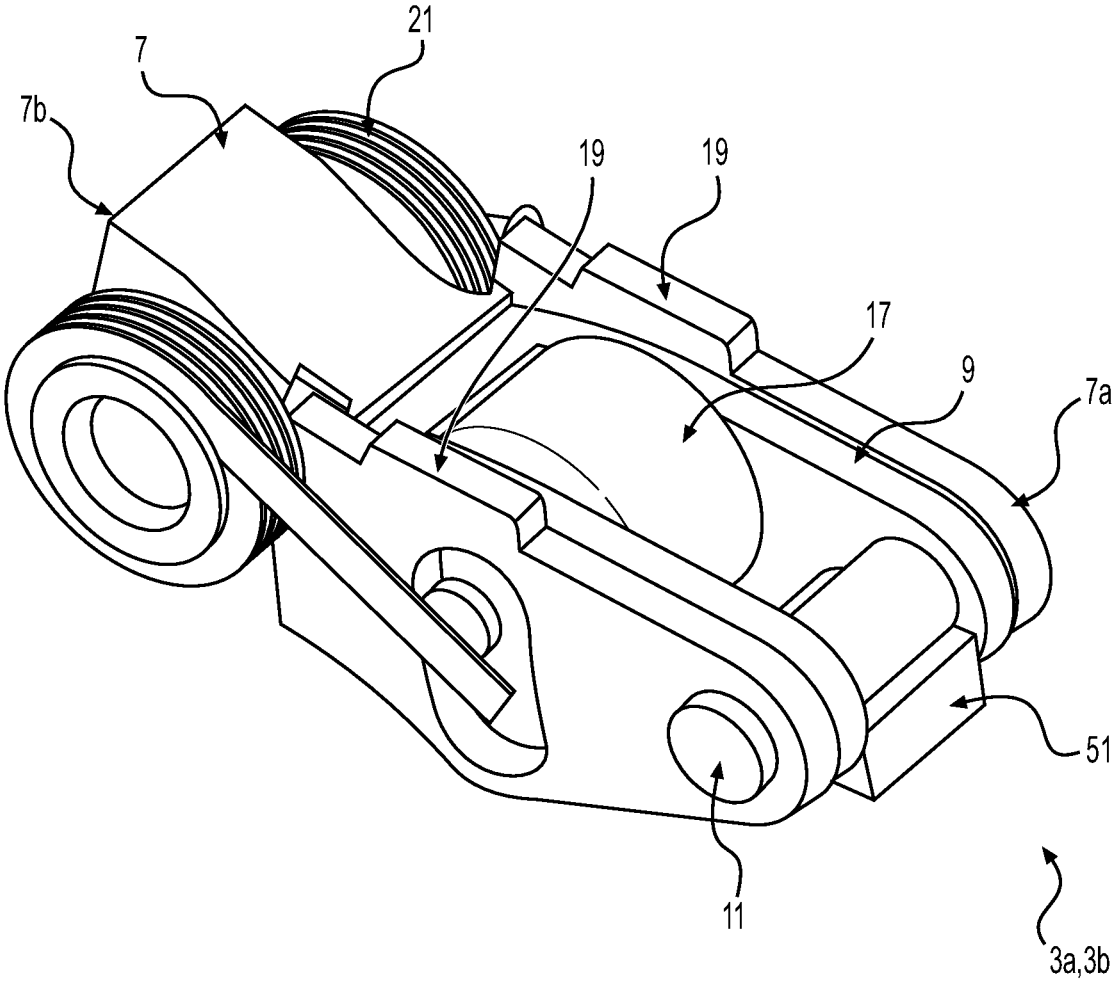
FIG. 1*c* illustrates schematically a perspective view of a rocker arm according to an example.

Referring to FIGS. 1*a* to 1*c*, a valve train assembly 1 comprises a pair of rocker arms 3*a*, 3*b* for actuating valves 40*a*, 40*b* for example exhaust valves, of a cylinder of an engine. For example, as illustrated in FIG. 1*a* to the rockers arms 3*a* and 3*b* may actuate a pair or valves 40*a*, 40*b*, for example exhaust valves 40*a*, 30*b*, of a first cylinder of the engine.

Each rocker arm 3*a*, 3*b* comprises an outer body 7 and an inner body 9 that are pivotably connected together at a pivot axis 11. A first end 7*a* of the outer body 7 contacts a valve stem 41*a*, 41*b* of the valve 40*a*, 40*b* and a second end 7*b* of the outer body 7 contacts a hydraulic lash adjuster (HLA) 42. The HLA 42 compensates for lash in the valve train assembly 1. The outer body 7 is arranged to move or pivot about the HLA 42. The outer body 7 contacts the valve stem 41*a*, 41*b* via a foot portion 51 attached to the pivot axis 11. Each rocker arm 3*a*, 3*b* further comprises at the second end 7*b* of the outer body 7 a latching arrangement (not shown in FIGS. 1*a* to 1 *c*, but see e.g. latching arrangement 13 of FIGS. 2*a*, 3, 4*a* and/or 5*a*) comprising a latch pin (not shown in FIGS. 1*a* to 1*c*, but see e.g. latch pin 15 of FIGS. 2*a*, 3, 4*a* and/or 5*a*) that can be urged between a first position in which the outer body 7 and the inner body 9 are un-latched and hence can pivot with respect to each other about the pivot axis 11 and a latched position in which the outer body 7 and the inner body 9 are latched together and hence can move or pivot about the HLA 42 as a single body.

Each inner body 9 is provided with an inner body cam follower 17, for example, a roller follower 17 for following a first cam profile 43 on a cam shaft 44. Each outer body 7 is provided with a pair of roller followers 19, in this example, slider pads 19 arranged either side of the roller follower 17 for following a pair of second cam profiles 45 mounted on the cam shaft 44. The first cam profile 43 comprises a base circle 43*a* and a lift profile 43*b*. In this example, the second cam profiles 45 are base circles 45 only, i.e. they comprise zero lift, and are for defining the position of the rocker arm 3*a*, 3*b* on the base circle 45. Each valve 40*a*, 40*b* comprises a valve spring for urging the rocker arm 3*a*, 3*b* against the cams 43, 45 of the cam shaft 44.

Each rocker arm further comprises a return spring arrangement 21 for returning the inner body 9 to its rest position after it is has pivoted with respect to the outer body 7.

When the latch pin (not shown in FIGS. 1*a* to 1*c*, but see e.g. latch pin 15 in other Figures) of a rocker arm 3*a*, 3*b* is in the latched position, that rocker arm 3*a*, 3*b* provides a first primary function, for example, the valve 40*a*, 40*b* it controls is activated as a result of the rocker arm 3*a*, 3*b* pivoting as a whole about the HLA 42 and exerting an opening force on the valve 40*a*, 40*b* it controls. For example, when the latch pin of the rocker arm 3*a* is in the latched position, and hence the inner body 9 and the outer body 7 are latched together, when the cam shaft 44 rotates such that the lift profile 43*b* of the first cam profile 43 engages the inner body cam follower 17, the rocker arm 3*a* is caused to pivot about the HLA 42 against the valve spring, and hence control the valve 40*a* to open.

When the latch pin (not shown in FIGS. 1*a* to 1*c*, but see e.g. latch pin 15 in other Figures) of a rocker arm 3*a*, 3*b* is in the un-latched position, that rocker arm 3*a*, 3*b* provides a second secondary function, for example, the valve 40*a*, 40*b* it controls is de-activated as a result of lost motion absorbed by the inner body 9 pivoting freely with respect to the outer body 7 about the pivot axis 11 and hence no opening force being applied to the valve 40*a*, 40*b*. For example, when the latch pin 15 of the rocker arm 3*a* is in the un-latched position, and hence the inner body 9 and the outer body 7 are unlatched, when the cam shaft 44 rotates such that the lift profile 43*b* of the first cam profile 43 engages the inner body cam follower 17, the inner body 9 is caused to pivot with respect to the outer body 7 about the pivot axis 11 against the return spring arrangement 21, and hence the rocker arm 3*a* is not caused to pivot about the HLA 42, and hence the valve 40*a* does not open. The cylinder associated with the valve 40*a* may thereby be deactivated (also referred to as cylinder deactivation).

In such a way, for example, the position of the latch pin may be used to control whether or not the rocker arm 3*a*, 3*b* is configured for cylinder deactivation.

Various arrangements for actuating latch pins of a rocker arms 3*a*, 3*b* of a valve train assembly 1, for example the valve train assembly 1 as described above with reference to FIGS. 1*a* to 1*c*, will now be described with reference to FIGS. 2*a* to 5*c*. Like reference signs denote like features.

Figure 2A:
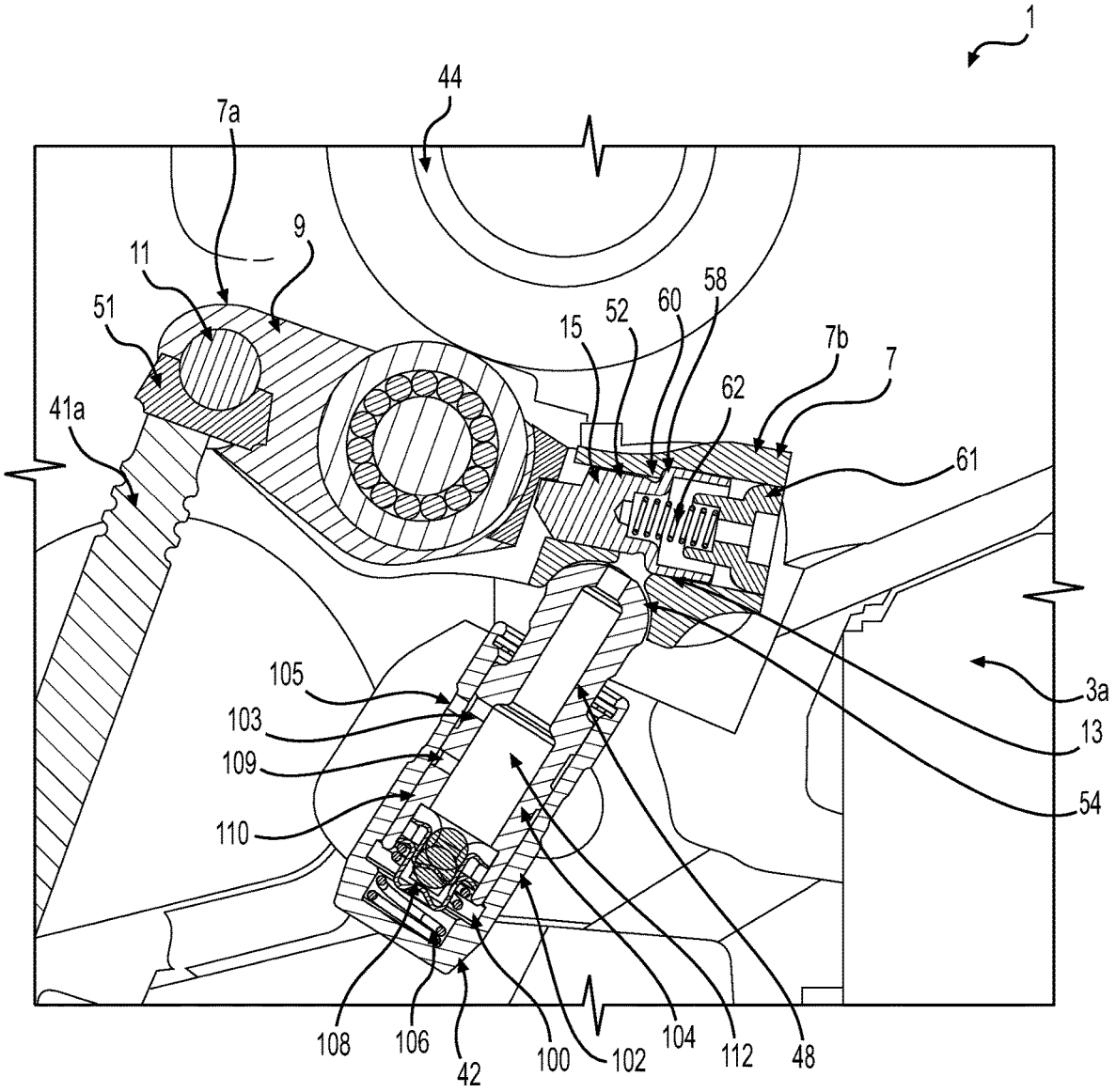
FIG. 2*a* illustrates schematically a cross sectional view of a portion of a valve train assembly according to an example.
Figure 2B:
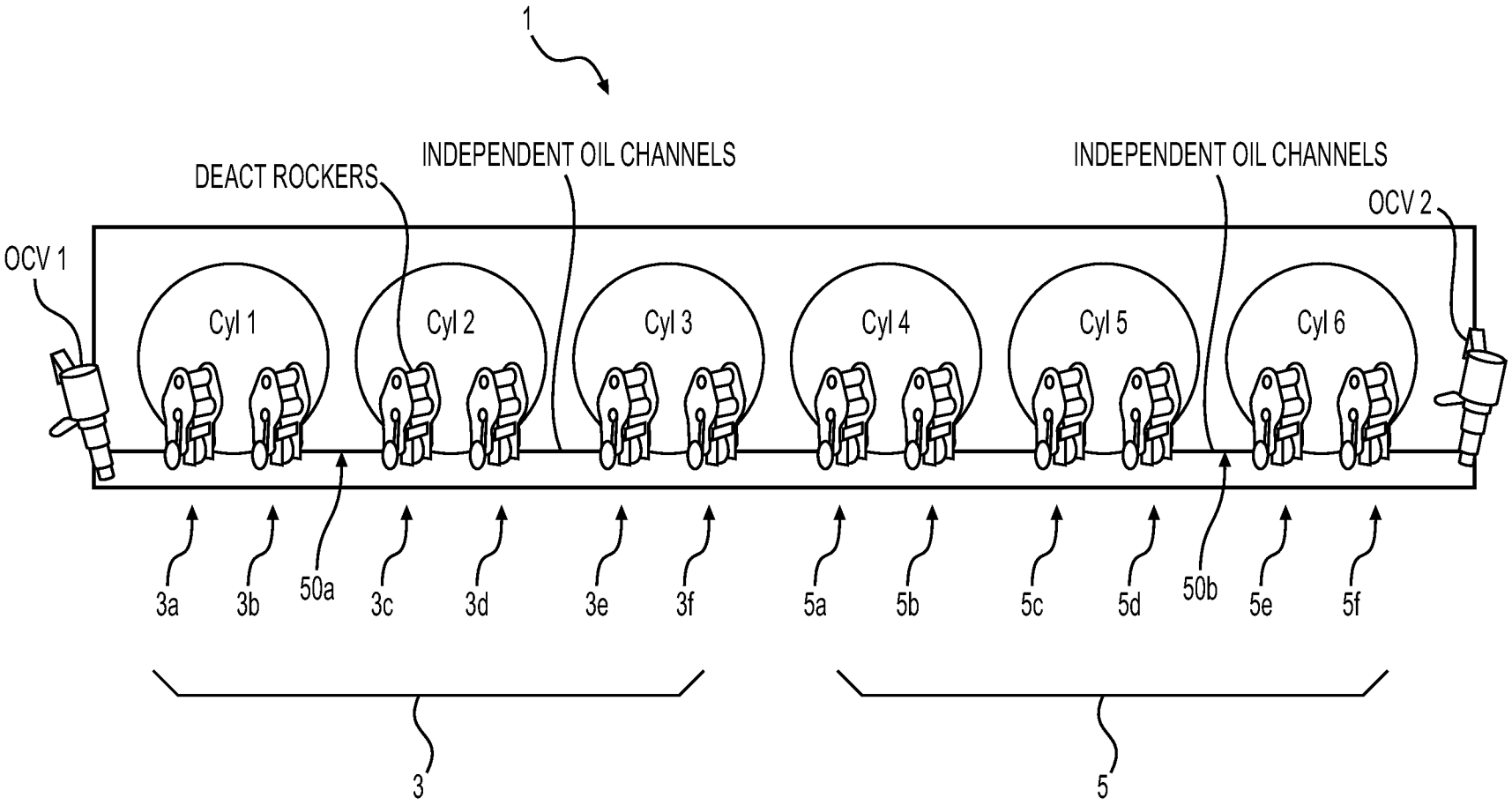
FIG. 2*b* illustrates schematically an arrangement of a valve train assembly according to an example.

A first example arrangement is illustrated in FIGS. 2*a* and 2*b*.

Referring to FIGS. 2*a* and 2*b*, similarly to as described with reference to FIGS. 1*a* to 1*c*, a valve train assembly 1 comprises a dual body rocker arm 3*a* for controlling a valve 40, for example an exhaust valve, of a cylinder (not visible in FIG. 2*a*) of an internal combustion engine. The dual body rocker arm 3*a* comprises an outer body 7, an inner body 9 mounted for pivotal motion with respect to the outer body 7 about a pivot axis 11, and a latching arrangement 13 comprising a latch pin 15 moveable between a first position (as illustrated in FIG. 2*a*) in which the outer body 7 and the inner body 9 are latched together and a second position (e.g. the latch pin 15 moved to the right in the sense of FIG. 2*a* with respect to the configuration as shown in FIG. 2*a*) in which the outer body 7 and the inner body 9 are un-latched.

The valve train assembly 1 further comprises a hydraulic lash adjuster (HLA) 42. The HLA 42 comprises a chamber 100 defined between an outer housing 102 and a plunger assembly 104 slidably mounted within the outer housing 102. The plunger assembly 104 contacts the rocker arm 3*a*. The HLA 42 comprises a spring 106 arranged to enlarge the chamber 100 by pushing the plunger assembly 104 outwardly from the outer housing 102 to extend the HLA 42. Hydraulic fluid (such as oil) flows into the chamber 100 via a one way valve 108, but can escape the chamber 100 only slowly via closely spaced leak down surfaces 110. Accordingly, the HLA 42 can extend to accommodate any slack in a valve train assembly 1, but after it is extended, the incompressible hydraulic fluid in the chamber 100 provides rigid support for the rocker arm 3*a* (i.e. the incompressible oil prevents the plunger assembly 104 being pushed back inwardly of the outer housing 102 so that the HLA 42 acts as a solid body). The HLA 42 has a second chamber 112, defined by the plunger assembly 104, on the other side of the one way valve 108 from the first chamber 100 and which is in fluid communication with a hydraulic fluid supply 50 (not visible in FIG. 2*a*) in communication with the engine's hydraulic fluid supply 50 via a first aperture 103 in a side wall of the plunger assembly 104 and a first aperture 105 in a side wall of the outer housing 102. Hydraulic fluid supplied to the second chamber 112 flows into the first chamber 100 through the one way valve 108 when the HLA 42 extends. The hydraulic fluid escaping slowly from the first chamber 100 via the leak down surfaces 110 flows back into the second chamber via a second aperture 109 in the side wall of the plunger assembly 104.

The HLA 42 comprises a conduit 48 for transferring hydraulic fluid from the hydraulic fluid supply 50 to the dual body rocker arm 3*a* in order to move the latch pin 15 of the rocker arm 3*a* from the latched position to the unlatched position. Specifically, the conduit 42 extends from the second chamber 112, through the plunger assembly 104 to the end of the plunger assembly 104 contacting the outer body 7 of the rocker arm 3*a*. The latch pin 15 is slidably disposed in a latch pin channel 52 formed in the outer body 7 of the rocker arm 3*a*. The latch pin channel 52 is in fluid communication with the conduit 48 of the HLA 42 so as to receive hydraulic fluid from the hydraulic fluid supply 50. Therefore, when a pressure of hydraulic fluid in the hydraulic fluid supply 50 is increased, the latch pin 15 is caused to move in the latch pin channel 52. The latch pin channel 52 is located at the second end 7*b* of the outer body, which comprises a HLA contact region 54 for contacting the HLA 42. The first, opposite, end 7*a* of the outer 7 comprises a valve stem contact region (or foot portion) 51 for contacting the stem 41*a* of the valve 40*a*.

The latch pin 15 defies a step 58 in its outer diameter arranged to abut against a corresponding step 60 in the diameter of the latch pin channel 52 to restrict the travel of the latch pin 15 in the latch pin channel 52 in a direction towards the inner body 9. The step 58 of the latch pin 15 also acts as a surface against which hydraulic fluid from the conduit 48 of the HLA 42 may exert a pressure so as to move the latch pin 15 in the latch pin channel 52 in a direction away from the inner body 9.

The latching arrangement 13 also comprises a stop 61 received in the latch pin channel 52 arranged to restrict the travel of the latch pin 15 in the latch pin channel 52 in a direction away from the inner body 9. The latching arrangement 13 comprises a biasing means 62 arranged to biasing the latch pin 15 towards the unlatched position. The biasing means 62 is received in the latch pin channel 52. The biasing means is a coil spring 62 that contacts at one end the latch pin 15 and at the other end the stop 61, and arranged to bias the latch pin 15 away from the stop 61 towards the inner arm 9 such that the default position of the latch pin 15 and hence the rocker arm 3*a* (i.e. when no, or equally a reduced pressure of, hydraulic fluid is supplied) is the latched position.

When the latch pin 15 is in the default latched position, for example when hydraulic fluid supplied by the hydraulic fluid supply 50 to the second chamber 112 and hence the conduit 48 is controlled to be at a relatively low pressure, the inner arm 9 and the outer arm 7 are latched together, and hence as described above for example provide for a first primary function where the valve 40*a* is activated as a result of the rocker arm 3*a* pivoting as a whole about the HLA 42 and exerting an opening force on the valve 40*a*.

When hydraulic fluid is supplied to the conduit 48 of the HLA 42, for example when the pressure of the hydraulic fluid in the hydraulic fluid supply 50 and hence conduit 48 is controlled to increase, the hydraulic fluid exerts a force on the latch pin 15 and moves the latch pin 15 away from the inner body 9, against the coil spring 62, i.e. to the un-latched position. The inner arm 9 and the outer arm 7 are therefore unlatched, and hence as described above for example, the rocker arm 3*a* provides a second secondary function, for example, the valve 40*a* is de-activated as a result of lost motion absorbed by the inner body 9 pivoting freely with respect to the outer body 7 about the pivot axis 11 and hence no opening force is applied to the valve 40*a*. Cylinder deactivation is therefore provided.

In such a way, for example, control of hydraulic fluid in the hydraulic fluid supply 50 may therefore be used to control the function of the rocker arm 3*a*, for example to control whether or not the rocker arm 3*a* is configured for cylinder deactivation. The hydraulic fluid supply 50 has a double functionality of both refilling the second chamber 112 of the HLA 42 and of providing the hydraulic fluid supply for causing the rocker arms 3*a* to switch between a latched state and an unlatched state.

As best seen in FIG. 2*b*, the valve train assembly 1 comprises a first group 3 of dual body rocker arms 3*a*, 3*b*, 3*c*, 3*d*, 3*e*, 3*f* and a second group 5 of dual body rocker arms 5*a*, 5*b*, 5*c*, 5*d*, 53, 5*f*. Rocker arms 3*a* and 3*b* are for controlling respective valves 40 (not visible in FIG. 2*b*) of a first cylinder Cyl 1 of the engine, rocker arms 3*c* and 3*d* are for controlling respective valves of a second cylinder Cyl 2 of the engine, rocker arms 3*e* and 3*f* are for controlling respective valves of a third cylinder Cyl 3 of the engine, rocker arms 5*a* and 5*b* are for controlling respective valves of a fourth cylinder Cyl 4 of the engine, rocker arms 5*c* and 5*d* are for controlling respective valves of a fifth cylinder Cyl 5 of the engine, and rocker arms 5*e* and 5*f* are for controlling respective valves of a sixth cylinder Cyl 6 of the engine. In this example the valves are each exhaust valves. In this example the first to sixth cylinders are arranged in consecutive order, for example arranged in a substantially straight line, with the first cylinder being adjacent to the second cylinder, the second cylinder being adjacent to the first cylinder and the third cylinder, the third cylinder being adjacent to the second cylinder and the fourth cylinder, and so on. The cylinders Cyl 1, Cyl 2, Cyl 3 controlled by the first group 3 are consecutive to the cylinders Cyl 4, Cyl 5, Cyl 6 controlled by the second group 5.

The valve train assembly 1 further comprises a first hydraulic fluid supply 50*a* for supplying hydraulic fluid in common to the dual body rocker arms 3*a*, 3*b*, 3*c*, 3*d*, 3*e*, 3*f* of the first group 3 in order to move the respective latch pins 15 of the dual body rocker arms 3*a*, 3*b*, 3*c*, 3*d*, 3*e*, 3*f* of the first group from the latched position to the unlatched position (and for refilling the second chambers 112 of the HLAs 42 thereof), for example as described above.

The valve train assembly 1 further comprises a second hydraulic fluid supply 50*b* for supplying hydraulic fluid in common to the dual body rocker arms 5*a*, 5*b*, 5*c*, 5*d*, 5*e*, 5*f* of the second group 5 in order to move the respective latch pins 15 of the dual body rocker arms 5*s*, 5*b*, 5*c*, 5*d*, 5*e*, 5*f* of the second group 5 from group from the latched position to the unlatched position (and for refilling the second chambers 112 of the HLAs 42 thereof) for example as described above. The second hydraulic fluid supply 50*b* is separate from the first hydraulic fluid supply 50*a*, that is supply of hydraulic fluid in the first hydraulic fluid supply 50*a* is independent of the supply of hydraulic fluid in the second hydraulic fluid supply 50*b*.

The hydraulic fluid supplies 50*a*, 59*b* may be, for example, ultimately supplied with hydraulic fluid from the engine's hydraulic fluid supply. The hydraulic fluid may be, for example, oil.

The first hydraulic fluid supply 50*a* is controllable independently of the second hydraulic fluid supply 50*b*, thereby to provide for controlling the latch pins 15 on a per cylinder group basis. Specifically, the valve train assembly 1 comprises a first hydraulic fluid control valve OCV 1 to control the supply of hydraulic fluid in the first hydraulic fluid supply 50*a* and a second hydraulic fluid control valve OCV 2 to control the supply of hydraulic fluid in the second hydraulic fluid supply 50*b*. Each hydraulic fluid control valve OCV1, OCV2 is controllable to increase a pressure of hydraulic fluid in the respective hydraulic fluid supply 50*a*, 50*b*, and controllable to decrease a pressure of hydraulic fluid in the respective hydraulic fluid supply 50*a*, 50*b*.

The valve train assembly comprises a controller arranged to control the first hydraulic fluid control valve OCV1 and the second hydraulic fluid control valve OCV2. The controller is arranged to control the hydraulic fluid control valves OCV1, OCV2 so as to supply hydraulic fluid to both, only one of, or neither of the first hydraulic fluid supply 50*a* and the second hydraulic fluid supply 50*b*. For example, when hydraulic fluid is supplied to neither of the first and the second hydraulic fluid supply 50*a*, 50*b*, then all of the rocker arms of both the first group 3 and the second group 5 will be in the latched state and hence control all of the first to sixth cylinders to be active. When hydraulic fluid is supplied to only the first hydraulic fluid supply 50*a*, then the rocker arms of the first group 3 will be in the unlatched state and hence control all of the first to third cylinders to be deactivated. In other words, cylinder deactivation is effected in only a proportion, in this case half, of the total cylinders of the engine. When hydraulic fluid is supplied to both the first hydraulic fluid supply 50*a* and the second hydraulic fluid supply 50*b*, then the rocker arms of the first group 3 and the second group 5 will be in the unlatched state and hence control all of the first to sixth cylinders to be deactivated. In other words, cylinder deactivation is effected in all of the cylinders of the engine. This corresponds to an engine shut off mode in which the engine is shut off.

This arrangement allows, for example, efficient and flexible control of cylinder deactivation in an internal combustion engine.

It will be appreciated that although six cylinders are illustrated in FIG. 2*b*, this need not necessarily be the case and that there may be a different number of cylinders. For example there may be four cylinders. In some examples, all exhaust valves 40 (and hence cylinders) of an engine may be de-actuated (deactivated) at the same time. In some examples, only a proportion of the exhaust valves 40 (and hence cylinders) of an engine may be de-actuated (deactivated) at the same time. For example, as above, 50% of the exhaust valves 40 may be de-actuated (deactivated) at the same time (i.e. in common). However, other proportions may be activated/deactivated at the same time, for example, in a six cylinder engine, ⅓ or ⅔ of the exhaust valves may be activated/deactivated at the same time (i.e. in common).

It will be appreciated that although all of the cylinders illustrated in FIG. 2*b* are controllable for cylinder deactivation this need not necessarily be the case and in other examples the engine may comprise cylinders which are not controllable as described above. Indeed the valve train assembly 1 may comprise a first group 3 of one or more dual body rocker arms for controlling one or more valves of a first cylinder, and a second group 5 of one or more dual body rocker arms for controlling one or more valves of a second cylinder, and may comprise a first hydraulic fluid supply for moving the respective latch pins of the one or more dual body rocker arms of the first group 3 and second separate hydraulic fluid supply for moving the respective latch pins of the one or more dual body rocker arms of the second group, the first hydraulic fluid supply being controllable independently of the second hydraulic fluid supply, thereby to provide for controlling the latch pins on a per cylinder basis. In this example, as above, the first group may comprises at least two said dual body rocker arms each for controlling a respective valve of the first cylinder, and the second group may comprise at least two said dual body rocker arms each for controlling a respective valve of the second cylinder.

It will be appreciated that the first group and/or the second group may further comprise one or more dual body rocker arms for controlling one or more said valves of one or more further cylinders, and that there may in principle be any number of further cylinders, for example one, two, three, four, or more.

Although in the example of FIG. 2*b* the cylinders associated with the first group are consecutive to the cylinders associated with the second group, this need not necessarily be the case and in other examples the cylinders associated with the first group (or equally the second group) may not be adjacent to one another. For example, in an example where there are four cylinders, the first and third cylinders may be associated with the first group and the second and fourth cylinders may be associated with the second group. This may apply equally to where there are six cylinders in total, for example.

A second example arrangement for actuating latch pins 15 of a rocker arms 3*a*, 3*b* of a valve train assembly 1, for example the valve train assembly 1 as described above with reference to FIGS. 1*a* to 1*c*, is now described with reference to FIG. 3. Like reference signs denote like features.

Figure 3:
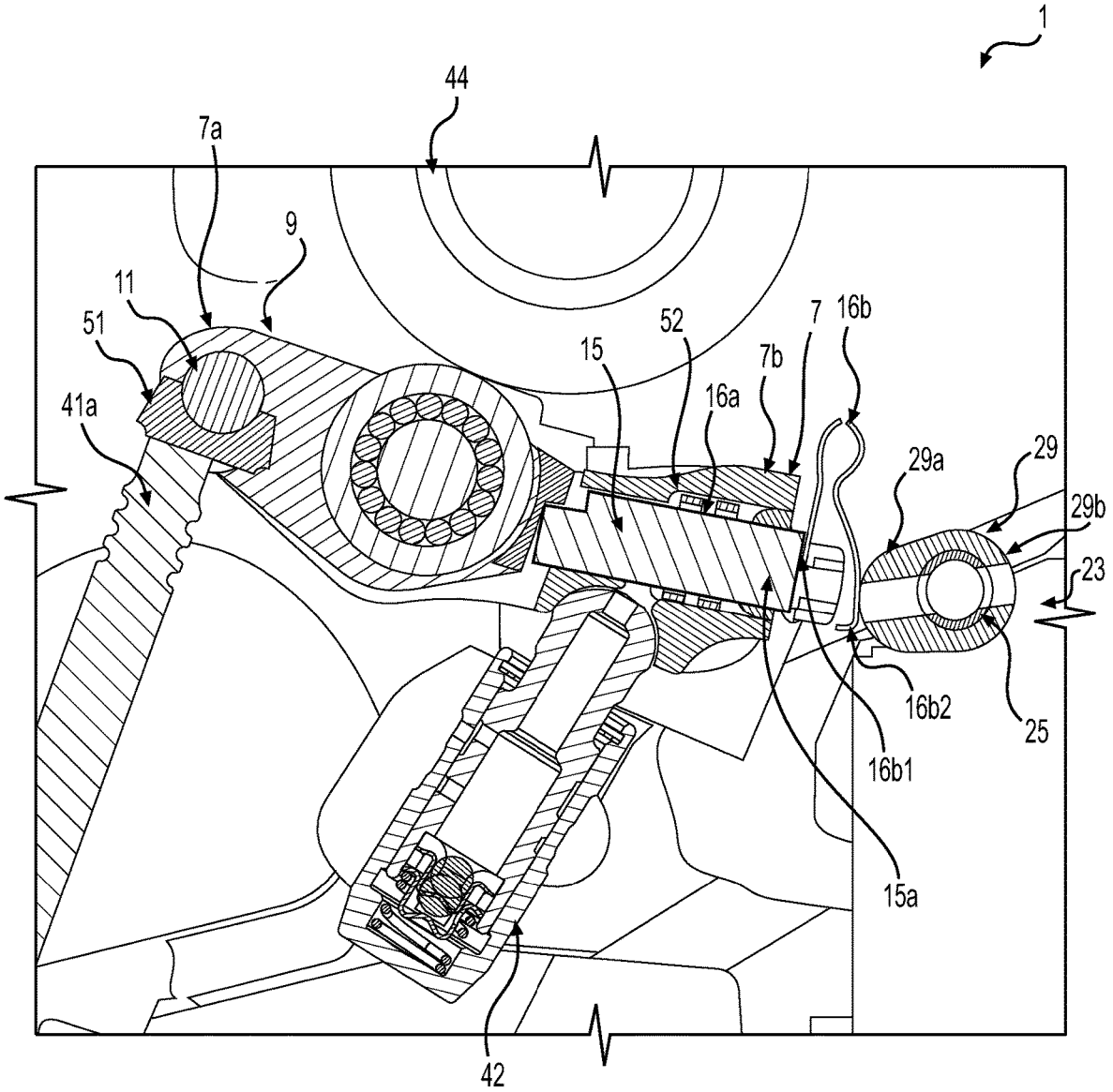
FIG. 3 illustrates schematically a cross section of a portion of a valve train assembly according to an example.

Referring to FIG. 3, similarly to as described with reference to FIGS. 1*a* to 1*c*, a valve train assembly 1 comprises a dual body rocker arm 3*a* for controlling a valve 40, for example an exhaust valve 40, of a cylinder (not visible in FIG. 3) of an internal combustion engine. The dual body rocker arm 3*a* comprises an outer body 7, an inner body 9 mounted for pivotal motion with respect to the outer body 7 about a pivot axis 11, and a latching arrangement 13 comprising a latch pin 15 moveable between a first position (as illustrated in FIG. 3) in which the outer body 7 and the inner body 9 are latched together and a second position (e.g. the latch pin 15 moved to the right in the sense of FIG. 3 with respect to the configuration as shown in FIG. 3) in which the outer body 7 and the inner body 9 are un-latched.

The valve train assembly 1 further comprises a hydraulic lash adjuster (HLA) 42. Although the HLA 42 shown in FIG. 3 is the same as that shown in FIG. 2*a*, it will be appreciated that this need not necessarily be the case and the HLA 42 in this example may be any type of hydraulic lash adjuster for compensating for lash in the valve train. For example, the HLA 42 in the example illustrated in FIG. 3 need not be arranged to supply hydraulic fluid to the rocker arm 3*a*. Supplying oil may nonetheless be useful, for example to lubricate the rocker arm 3*a*, for example.

The valve train assembly 1 further comprises an actuation arrangement 23 for operating the latch pins 15. In this example, the actuation arrangement 23 comprises an elongate shaft 25 that is rotatable by an actuator 27 (not shown in FIG. 3), for example an electric motor (not shown in FIG. 3). The actuation arrangement 23 comprises a selector cam 29 mounted thereon for operating the latch pin 15. In this example, the selector cam 29 comprises a lobe profile 29*a* and a base circle 29*b*. When the rotational orientation of the shaft 25 is such that a lobe profile 29*a* the selector cam 29 contacts the latching arrangement 13 the latching pin 15 in that arrangement is caused to move into the latched position. Once latched, the latch pin 15 is kept latched by the selector lobe profile 29*a* cam 29. When the rotational orientation of the shaft 25 is such that a base circle 29*b* of the selector cam 29 contacts the latching arrangement 13 (or there is no contact between the two) the latching pin 15 in that arrangement is in the un-latched position.

The latch pin 15 is received in a latch pin channel 52 formed in the outer body 7 of the rocker arm 3*a*. The latching arrangement 13 comprises a first biasing means (e.g. coil spring 16*a*) arranged around the latch pin 15 and within a portion of the latch pin channel 52. The first biasing means 16*a* urges the latching pin 15 towards the selector cam 29, i.e. away from the inner body 9 such that the default position of the latch pin 15 is unlatched. When the dual body rocker arm 3*a* is in a typical, activatable, state, the actuation source driving the actuator arrangement 23, causes the lobe profile 29*a* of the selector cam 29 to contact the latching arrangement 23, which causes the latch pin 15 to move against the spring 16*a* from the unlatched position to the latched position (as illustrated in FIG. 3) immediately.

The dual body rocker arm 3*a* be in an un-activatable state and hence the latch pin 15 may not be able to be actuated immediately. For example, the dual body rocker arm 3*a* may be in an un-activatable state because the inner arm 9 is pivoted with respect to the outer arm 7 about the pivot axis 11 because the first cam profile (not shown in FIG. 3) of the cam shaft 44 is engaging the inner body cam follower 17, and hence the latch pin 15 is blocked from moving to the latched position by the inner body 9.

The latching arrangement 13 also comprises a second biasing means (e.g. a spring) (so called compliance spring) 16*b* that is biased (compressed, pre-loaded) if the selector cam 29 attempts to cause the latching pin 15 to move into the latched position at a time when it cannot do so (e.g. because of the relative orientations of the inner 9 and outer 7 arms) so as to then cause the latching pin 15 to move into the latched position when it becomes free to do so. In other words, the compliance spring 16*b* becomes compressed by the actuator arrangement 23 when the actuation source drives the actuator arrangement 23 when the actuation source attempts to move the latch pin 15 from the unlatched position to the latched position, via the actuator arrangement 23, when the dual body rocker arm 3*a* is in an un-activatable state in which the latch pin is non-moveable, whereby the compliance spring 16*b* causes the latch pin 15 to move from the unlatched to the latched position when the dual body rocker arm 3*a* is in an activatable state in which the latch pin 15 is moveable again.

The compliance function provided by the spring 16 allows the dual body rocker arm 3*a* to be actuated as soon as that is physically possible, even if a specific engine condition does not allow immediate actuation. This provides for reliable actuation. Further, this allows for the control of the actuation source to not necessarily be synchronised with an engine condition, which may otherwise be complicated and expensive and hence inefficient.

In the example shown in FIG. 3, the compliance spring 16*b* is a leaf spring 16*b*. The leaf spring 16*b* is substantially external of the dual body rocker arm 3*a*, that is, exterior to the inner body 9 and outer body 7 of the rocker arm 3*a*. A first end 16*b*1 of the leaf spring 16 is attached to the latch pin 15 at an end 15*a* of the latch pin 15 closest to the selector cam 29. The second end 16*b*2 of the leaf spring is for contacting the actuation arrangement 23, specifically the selector cam 29. In use, the leaf spring 16 becomes compressed by the lobed profile 29*a* of the selector cam 29 when the actuation source rotates the shaft 25 when the actuation source attempts to move the latch pin 15 from the unlatched position to the latched position, via the selector cam 29, when the dual body rocker arm is in the un-activatable state, whereby the leaf spring 16 expands and thereby causes the latch pin 15 to move from the unlatched position to the latched position when the dual body rocker arm 3*a* is in the activatable state again.

The use of an external leaf spring 16*b* as a compliance spring 16*b* as described above allows the compliance function to be provided without modifications to the interior of the dual body rocker arm 3*a*, which may be expensive and time consuming.

A third example arrangement for actuating latch pins 15 of a rocker arms 3*a*, 3*b* of a valve train assembly 1, for example the valve train assembly 1 as described above with reference to FIGS. 1*a* to 1 *c*, is now described with reference to FIGS. 4*a* to 4*f* Like reference signs denote like features.

Referring to FIGS. 4*a* to 4*f*, similarly to as described above with reference to FIGS. 1*a* to 1*c*, a valve train assembly 1 comprises pairs of rocker arms 3, 5 for actuating valves (not shown in FIGS. 4*a* to 4*f*) of cylinders (not shown in FIGS. 4*a* to 40 of an engine.

Figure 4A:
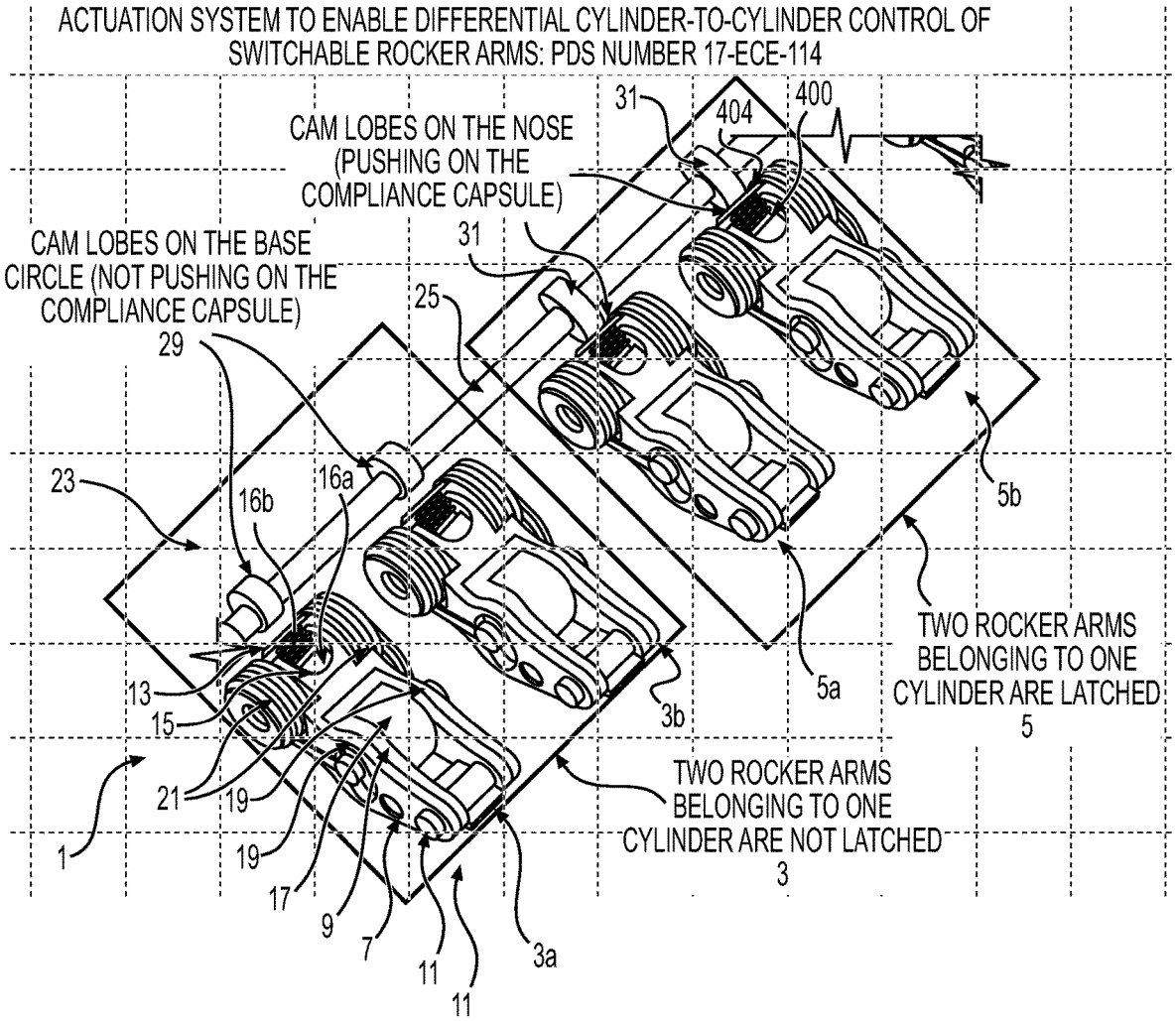
FIGS. 4*a* to 4*f* illustrate schematically a valve train assembly with an actuation arrangement in different configurations according to an example.
Figure 4B:
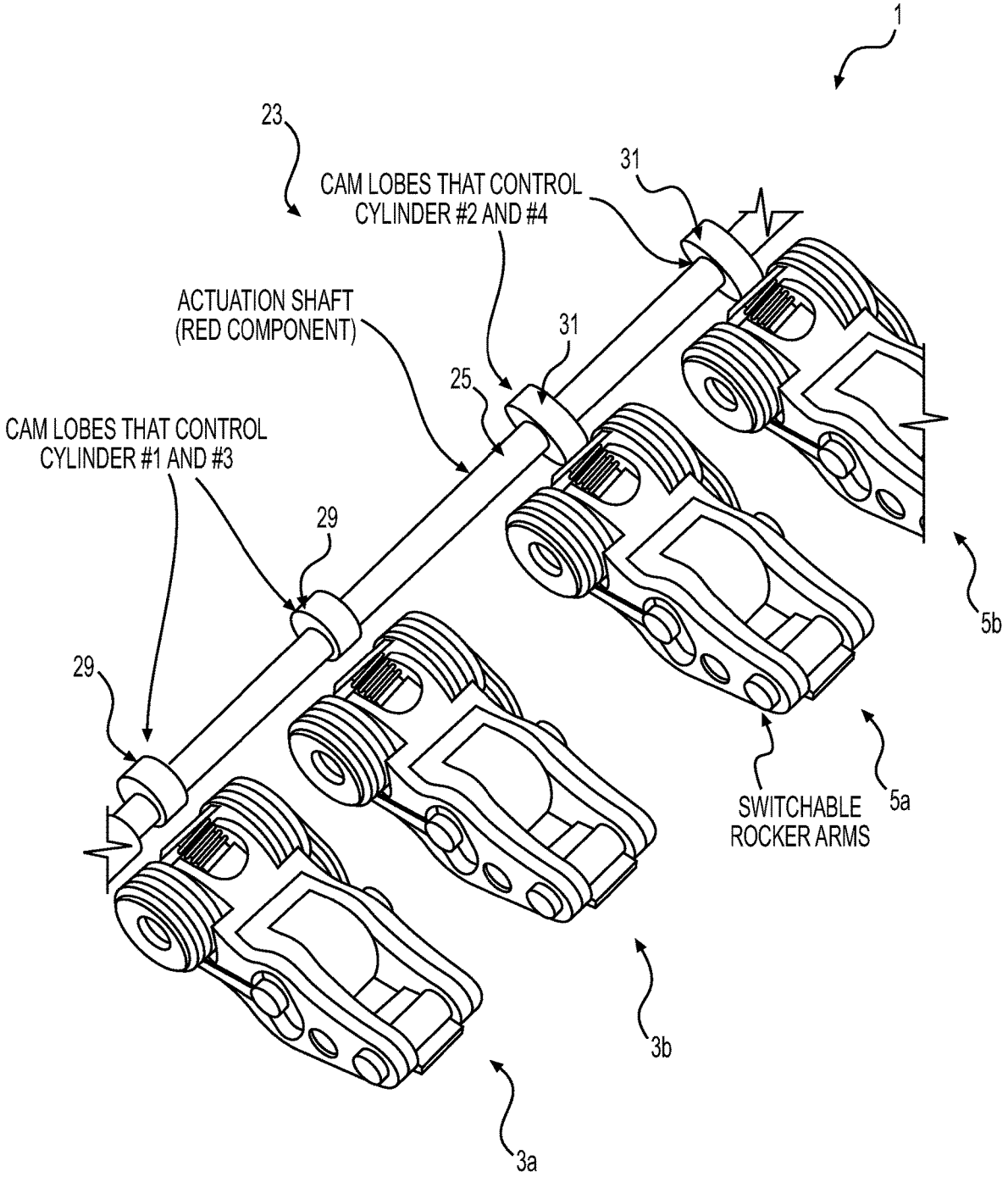

For example, as illustrated in FIG. 4*a*, the rocker arms 3*a* and 3*b* of a first pair of rockers arms 3 may actuate a first pair or valves of a first cylinder of the engine and the rockers arms 5*a* and 5*b* of second pair of rockers arms 5 may actuate a second pair or valves of a second cylinder of the engine. Accordingly, as illustrated in FIG. 4*f*, two such pairs of rocker arms 3 (i.e. a first group 3 of rocker arms) may activate pairs of valves of each of the first and third cylinders of the engine and two such pairs of rocker arms 5 (i.e. a second group 5 of rocker arms) may activate pairs of valves of each of the second and fourth cylinders of the engine. In such a way, the first group 3 and the second group 4 control alternate cylinders of the engine.

Similarly to as described above with reference to FIGS. 1*a* to 1*c*, each rocker arm comprises an outer body 7 and an inner body 9 that are pivotably connected together at a pivot axis 11. Each rocker arm further comprises at one end a latching arrangement 13 (also referred to as a compliance capsule in FIGS. 4*a* to 40 comprising a latch pin 15 that can be urged between a first position in which the outer body 7 and the inner body 9 are un-latched and hence can pivot with respect to each other and a latched position in which the outer body 7 and the inner body 9 are latched together and hence can move or pivot about a pivot point as a single body.

As described above, when the latching pin 15 of a rocker arm is in the latched position, that rocker arm provides a first primary function, for example, the valve it controls is activated as a result of the rocker arm pivoting as a whole about a pivot point and exerting an opening force on the valve it controls. When the latching pin 15 of a rocker arm is in the un-latched position, that rocker arm provides a second secondary function, for example, the valve it controls is de-activated as a result of lost motion absorbed by the inner body 9 pivoting freely with respect to the outer body 7 and hence no opening force being applied to the valve.

As described above, each inner body 9 is provided with an inner body cam follower 17, for example, a roller follower for following an auxiliary cam profile on a cam shaft and each outer body 7 is provided with a pair of roller followers 19, in this example, slider pads arranged either side of the roller follower 17 for following a pair of primary cam profiles mounted on the cam shaft. Each rocker arm further comprises a return spring arrangement 21 for returning the inner body 9 to its rest position after it is has pivoted with respect to the outer body 7.

The valve train assembly 1 further comprises an actuation arrangement 23 for operating the latch pins 15. In this example, the actuation arrangement 23 comprises an elongate shaft 25 that is rotatable by an actuator 27, for example an electric motor 27. The actuation arrangement comprises a plurality of selector cams 29, 31 mounted thereon for operating the latch pins 15. When the rotational orientation of the shaft 25 is such that a lobe profile of any given selector cam 29, 31 contacts its respective latching arrangement the latching pin in that arrangement is caused to move into the latched position. When the rotational orientation of the shaft 25 is such that a base circle of any given selector cam 29, 31 contacts its respective latching arrangement (or there is no contact between the two) the latching pin 15 in that arrangement is in the un-latched position.

Similarly to as described above, each latching arrangement 13 may comprise a first spring 16*a* that urges its latching pin 15 towards its selector cam 29, 31. Each latching arrangement 13 may also comprise a second spring (so called compliance spring) 16*b* that is compressed if the selector cam 29, 31 attempts to cause the latching pin to move into the latched position at a time when it cannot do so (e.g. because of the relative orientations of the inner and outer arms) so as to then cause the latching pin 15 to move into the latched position when it becomes free to do so. In this example, the first spring 16*a* and the second spring 16*b* are coil springs. In this example, the first spring 16 is arranged around the latched pin 15 and contacts at one end a shelf 400 attached to the latch pin 15, and at the other end the outer body 7 of the rocker arm 3*a*. In this example, the compliance spring 16*b* is arranged around the latch pin 15, and at one end contacts the shelf 400 attached to the latch pin 15, and at another end contacts a contact element 404 arranged for reciprocal movement with respect to the latch pin 15, and arranged for contact with the selector cam 29, 31. The compliance spring 16*b* biases the contact element 404 away from the shelf 400 and hence away from the latch pin 15 and towards the selector cam 29, 31. The compliance spring 16*b* is compressed if the selector cam 29, 31 attempts to cause the latching pin 15 to move into the latched position at a time when it cannot do so and, and causes the latching pin 15 to move into the latched position when it becomes free to do so.

In this example, the selector cams 29, 31 comprise first selector cams 29 that control the latching pins 15 of a first group of rocker arms, in the is example the rocker arms of the first cylinder (see FIGS. 4*a* to 4*e*) and of the third cylinder (see FIG. 40 and second selector cams 31 that control the latching pins of a second group of rocker arms, in this example the rocker arms of the second cylinder (see FIGS. 4*a* to 4*e*) and of the fourth cylinder (see FIG. 40. The first selector cams 29 are of a first shape and the second selector cams 31 are of a second different shape.

As described in more detail below, the selector cam lobe shapes allows delivery or not of the secondary function depending on its position compared to the actuator shaft 25.

Figure 4C:
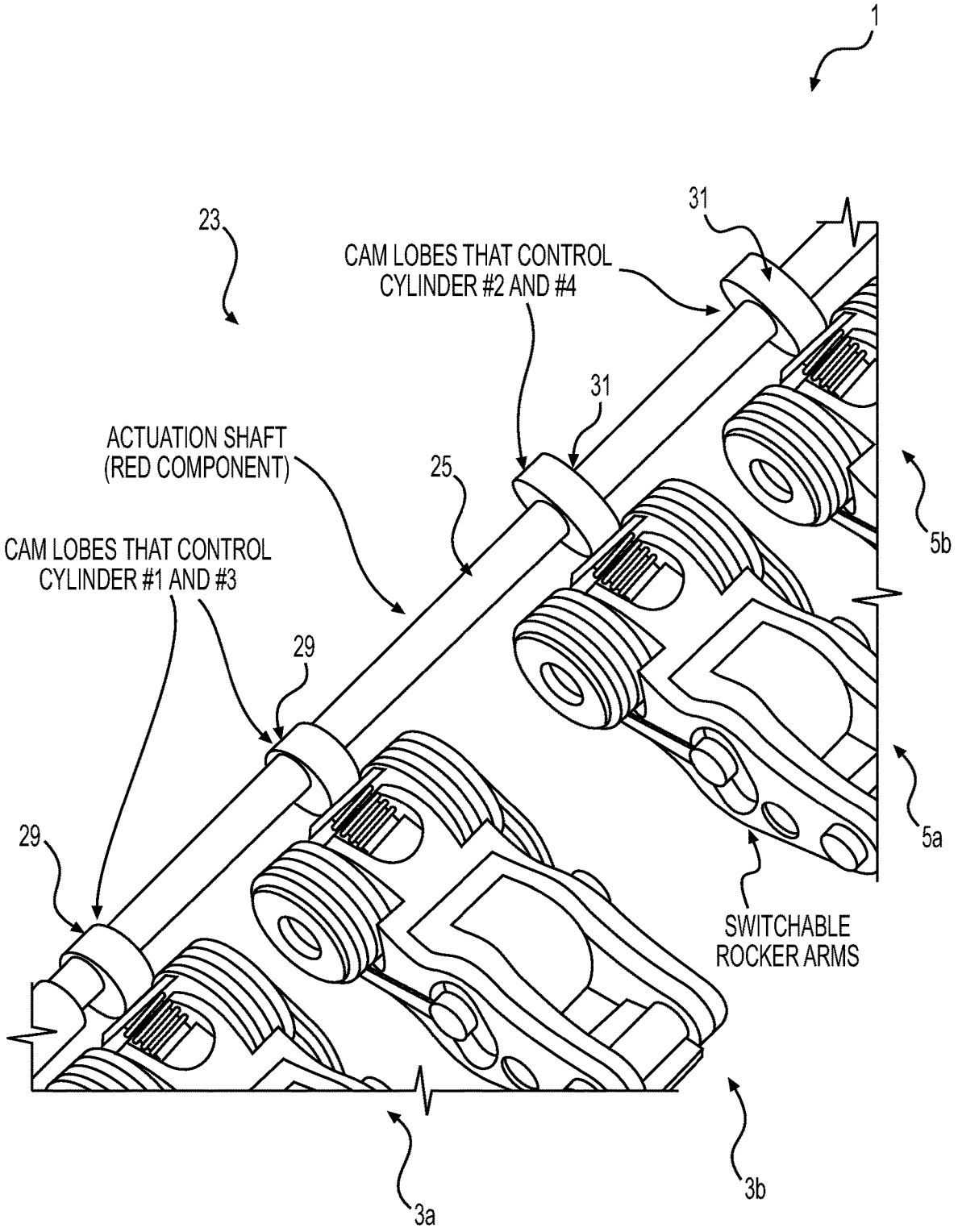

The arrangement 23 can deliver the primary function (for example, engine running in standard combustion mode: main valve lift on) on all the cylinders (see for example FIG. 4*c* and FIG. 40 when both the selector cam types 39, 31 are on the nose (i.e. when the selector cams 29, 31 apply a force to the latch pin 15). Once the actuator shaft 25 moves to a subsequent position, the cylinders will deliver the primary or secondary function according to the cam lobe shape and position.

Figure 4D:
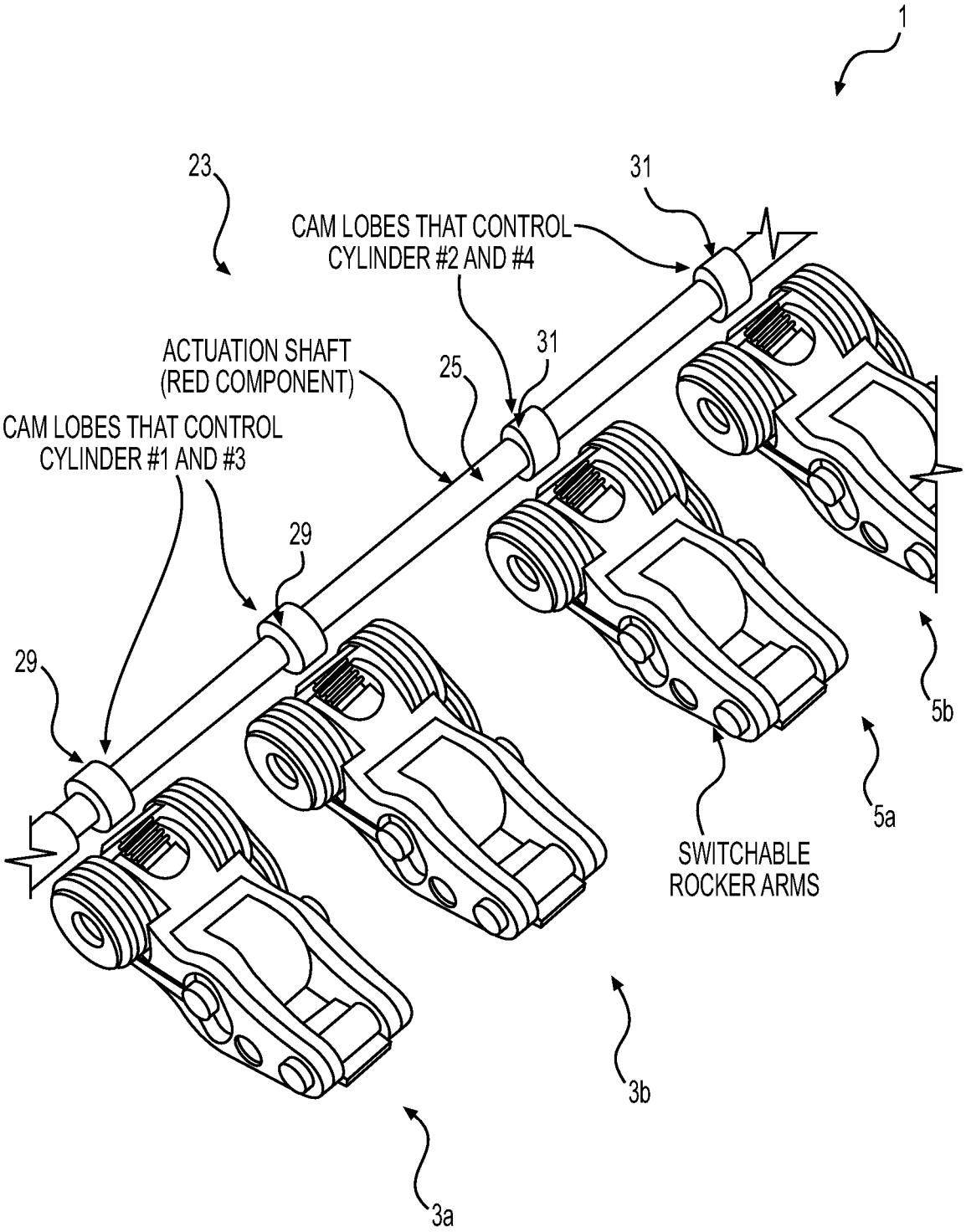
Figure 4E:
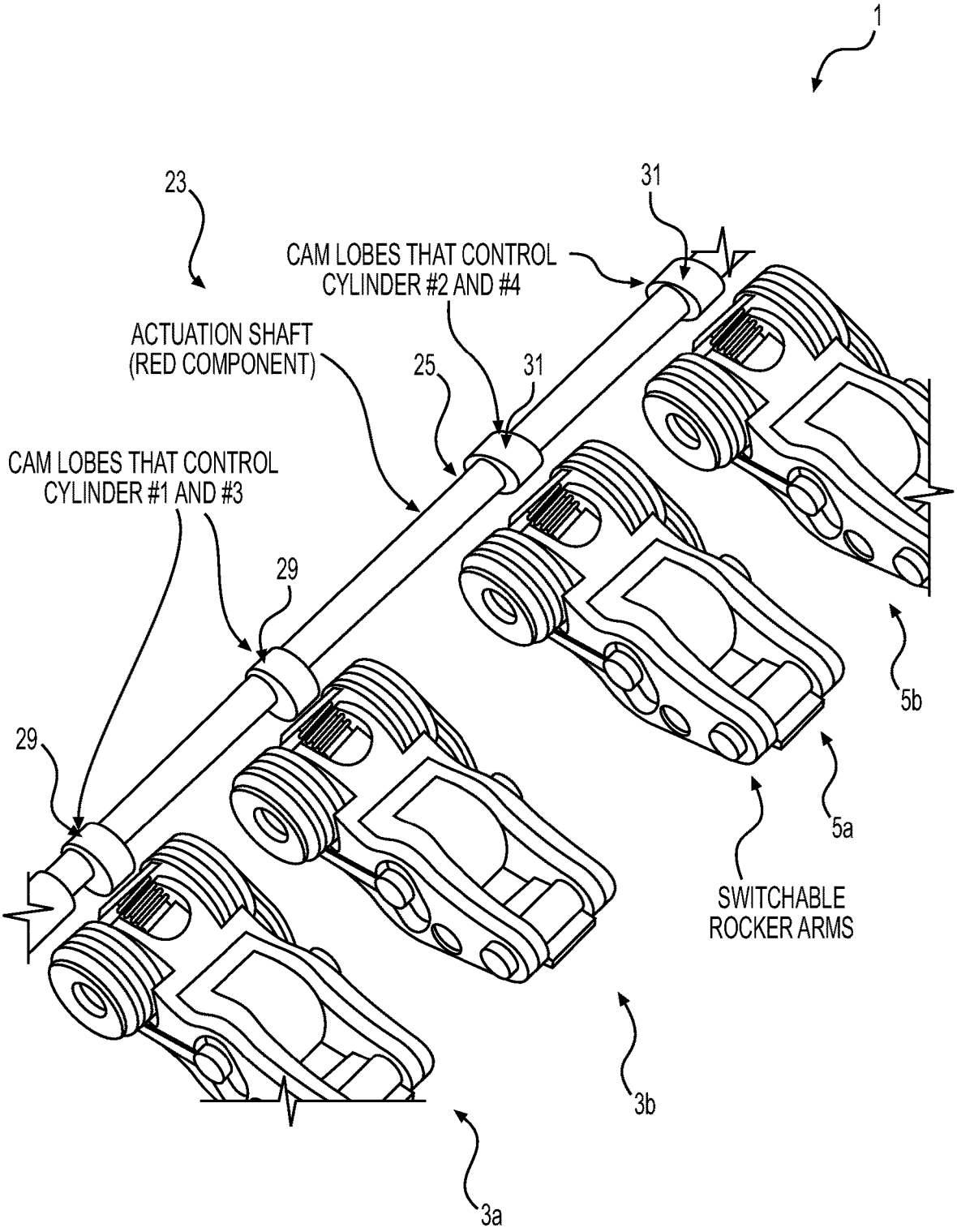
Figure 4F:
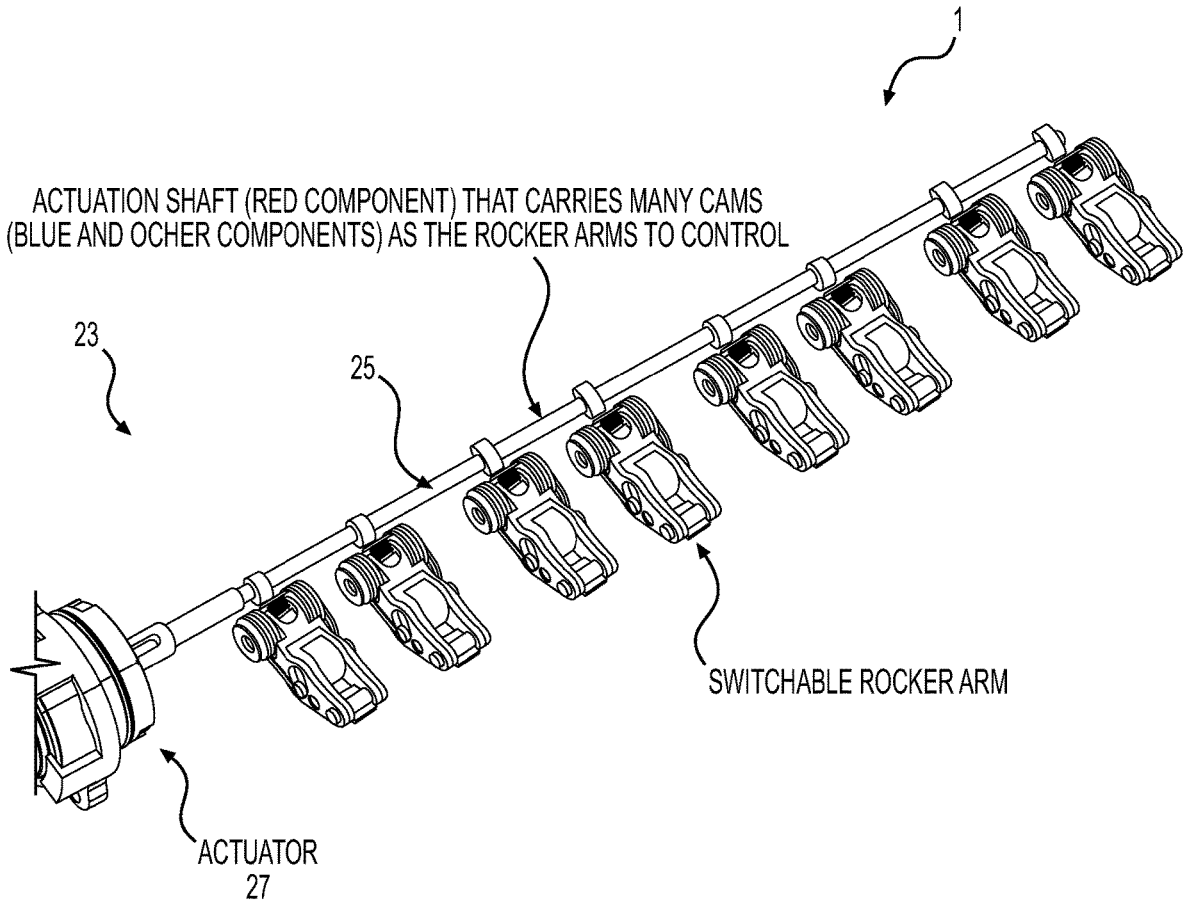

For example, as illustrated in FIG. 4*e* the first cylinder is delivering primary function (acting on the Rocker Arm by means of the cam lobe nose), while the second cylinder is delivering the secondary one (no contact with the Rocker Arm, cam on the base circle) and, vice versa as illustrated in FIG. 4*b*. Similarly in a four cylinder engine the actuation arrangement 23 may be configured so that the first and third cylinders deliver the primary function while cylinders two and four provide the secondary function or vice versa. In the orientation of FIG. 4*d*, all cylinders provide the secondary function (for example, cylinder deactivation).

Every cylinders combination may be achieved by setting up the cams position (even only one cylinder actuated by the system is feasible). Depending on the number of positions delivered by the actuator, it is possible to get additional functions from the engine (e.g.: all the cylinders shut off, primary function on cylinders two and four and secondary function on cylinders one and three.

The system is able to manage all the numbers of cylinders per engine bank of the typical engine configuration in the market.

Accordingly, the described external actuation system is able to allow independent control of each cylinder on the same engine using a single actuator.

In some examples, each cylinder of the engine can deliver a different secondary function, with respect to another cylinder, by selecting the proper actuator position phased with the external device which controls the latching/unlatching of the rocker arm.

The described arrangement allows to use only one actuator (which facilitates packaging and control) that delivers the needed motion to latch pins of all the switchable rocker arms; phasing the cam lobes assembled on the actuation system with the actuator position, it is possible to get the desired function for each cylinder.

Figure 5A:
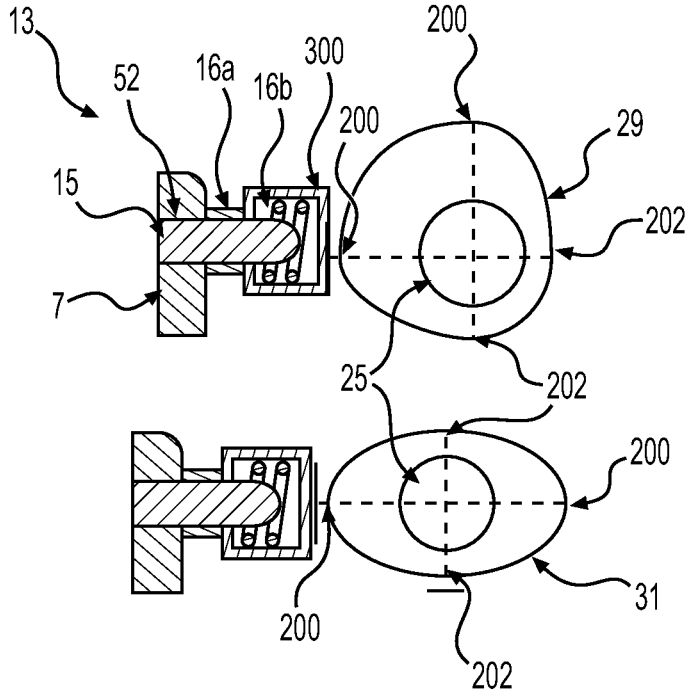
FIG. 5*a* illustrates schematically cross sectional views of differently shaped selector cams according to an example.
Figure 5B:
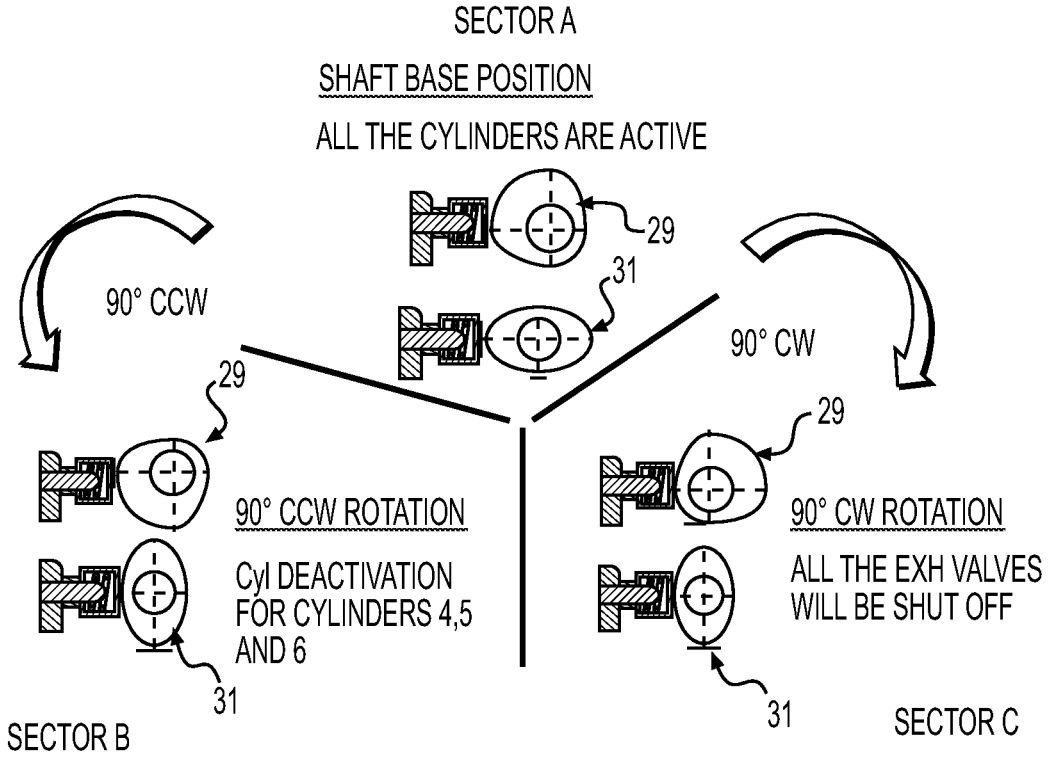
FIG. 5*b* illustrates schematically a flow diagram for different configurations of an actuator arrangement according to an example.

Referring to FIGS. 5*a* and 5*b* there is illustrated a specific example of differently shaped selector cams 29, 31 for example of the actuation arrangement 23 described above with reference to FIGS. 4*a* to 4*f*.

As best seen in FIG. 5*a*, each selector cam 29, 31 comprises one or more lobed portions 200 for applying a force to the latching arrangement 13 of the respective rocker arm 3*a*, 3*b*, 5*a*, 5*b*, of the respective groups of rocker arms 3, 5. Each selector cam 29, 31 also comprises a base circle portion 202 for applying substantially no force to (for example not contacting) the latching arrangement 13 of the respective rocker arm 3*a*, 3*b*, 5*a*, 5*b*. The first selector cams 29 comprise two such lobed portions 200 arranged substantially at right angles to one another about a rotational axis of the shaft 25. The second selector cams 31 comprise two such lobed portions 200 arranged substantially opposite one another about a rotational axis of the shaft 25. The lobed portions 200 of the second selector cams 31 are substantially parallel to one 200*a* of the two the lobed portions 200 of the first selector cams 28.

Similarly to as described above, the latching arrangement 13 comprises a latch pin 15 slidably disposed in a latch pin channel 52, formed in the outer body 7 of the dual body rocker arm 3*a* at an end of the outer body 7 further defining a contact region for contacting the hydraulic lash adjuster. The latching arrangement 13 comprises a first biasing means (e.g. a coil spring) 16*a* for biasing the latch pin 15 to the default unlatched position. The selector cams 19, 31 move the latch pin 15 from the unlatched to the latched position against the first biasing means 16*a*. The latching arrangement 13 comprises second biasing means (also referred to as a compliance spring) 16*b*. In this example, the compliance spring 16*b* is connected at a first end to the latch pin 15 and at a second end to a cap 300 for contacting the selector cam 29, 31, and biases the cap 300 away from the latch pin 15. In other examples, the compliance spring may be a leaf spring 16*b*, for example as described above with reference to FIG. 3. In either case, in use, the compliance spring 16*b* becomes biased by the actuator arrangement 23 when the actuation source 27 drives the actuator arrangement 23 when the actuation source 27 attempts to move the latch pin 15 from the unlatched position to the latched position, via the actuator arrangement 23, when the dual body rocker arm 3*a* is in an un-activatable state in which the latch pin 15 is non-moveable, whereby the compliance spring 16*b* causes the latch pin 15 to move from the unlatched position to the latched position when the dual body rocker arm 3*a* is in an activatable state in which the latch pin 15 is moveable again. In this way, movement of the latch pin 15 may be effected via the selector cam 29, 31 for a given rocker arm as soon as it is possible to do so.

As best seen in FIG. 5*b*, the different shapes of the selector cams 29, 31 allows, by rotation of the common shaft 25 by an action source 27, for example an electric motor 27, a per group 3, 5 control of the latched or unlatched position of the latch pin 15 of the respective rocker arms.

In sector A of the flow diagram of FIG. 5*b*, the selector cams 29, 31 are positioned (i.e. rotationally orientated) such that both have a lobed portion 200 aligned with the latching arrangement 13 such that both selector cams 29, 31 apply a force to the latching arrangement 13 and hence cause the latch pin 15 of the respective rocker arms 3*a*, 5*a* to be in the latched position. In this orientation, all the rocker arms will provide the first primary function, and hence in this example all of the cylinders will be active.

Rotation of the shaft 25 by 90° counter clockwise (CCW) in the sense of FIG. 5*b* from the orientation as illustrated in sector A results in the orientation of selector cams 29, 31 as shown in sector B. In sector B of the flow diagram of FIG. 5*b*, the first selector cams 29 are positioned (i.e. rotationally orientated) so as to have a lobed portion 200 aligned with the latching arrangement 13 such that the first selector cams 29 apply a force to the latching arrangement 13 and hence cause the latch pin 15 of the respective rocker arms 3*a* of the first group 3 to be in the latched position, but the second selector cams 31 are positioned (i.e. rotationally orientated) so as to have a base circle portion 202 aligned with the latching arrangement 13 (i.e. the lobed portions 200 misaligned with the latching arrangement 13) such that the second selector cams 31 apply substantially no force to (or do not contact) the latching arrangement 13 and hence allow the latch pins 15 of the respective rocker arms 5*a* of the second group 5 to be in the default unlatched position. In this orientation, the rocker arms 3*a*, 3*b* of the first group 3 will provide the first primary function (e.g. where the associated cylinders are active), and the rocker arms 5*a*, 5*b* of the second group 5 will provide the second secondary function (e.g. cylinder deactivation), and hence only a proportion of the cylinders will be active.

Rotation of the shaft 25 by 90° clockwise (CW) in the sense of FIG. 5*b* from the orientation as illustrated in sector A results in the orientation of selector cams 29, 31 as shown in sector C. In sector C of the flow diagram of FIG. 5*b*, the selector cams 29, 31 are positioned (i.e. rotationally orientated) such that both have a base circle portion 202 aligned with the respective latching arrangements 13 (i.e. both have their respective lobed portions 200 misaligned with the respective latching arrangements 13) such that both selector cams 29, 31 apply substantially no force to (or not contact) the latching arrangement 13 and hence allow the latch pins 15 of the respective rocker arms 3*a*, 3*b*, 5*a*, 5*b* of the first group 3 and the second group 5 to be in the default unlatched position. In this orientation, all the rocker arms will provide the second secondary function, and hence all of the cylinders will be deactivated, and hence the engine will shut off.

The actuator arrangement 23 may comprise a controller arranged to control the rotation of the actuation source 27 thereby to control rotation of the shaft 25. For example, the controller may be arranged to control the rotational orientation of the shaft 25, for example in 90° steps as described above, such that both, one of, or neither of the first cams 29 and second cams 31 apply a force to the latching arrangements 13 of the respective dual body rocker arms 3*a*, 3*b*, 5*a*, 5*b*.

The different selector cam 29, 31 shapes and control described above with reference to FIGS. 5*a* and 5*b* may be used, for example, in the valve train assembly 1 described above with reference to FIGS. 4*a* to 4*f* For example, the first group 3 may comprise at least two dual body rocker arms 3*a*, 3*b* each for controlling a respective valve of a first cylinder, and the second group 5 may comprise at least two dual body rocker arms 5*a*, 5*b* each for controlling a respective valve of a second cylinder of an engine. Indeed, the first group 3 may comprise one or more dual body rocker arms 3*a*, 3*b* for controlling one or more valves of a third cylinder, and the second group 5 may comprise one or more dual body rocker arms 5*a*, 5*b* for controlling one or more valves of a fourth cylinder. In some examples, the first to fourth cylinders may be arranged in sequential order.

Figure 5C:
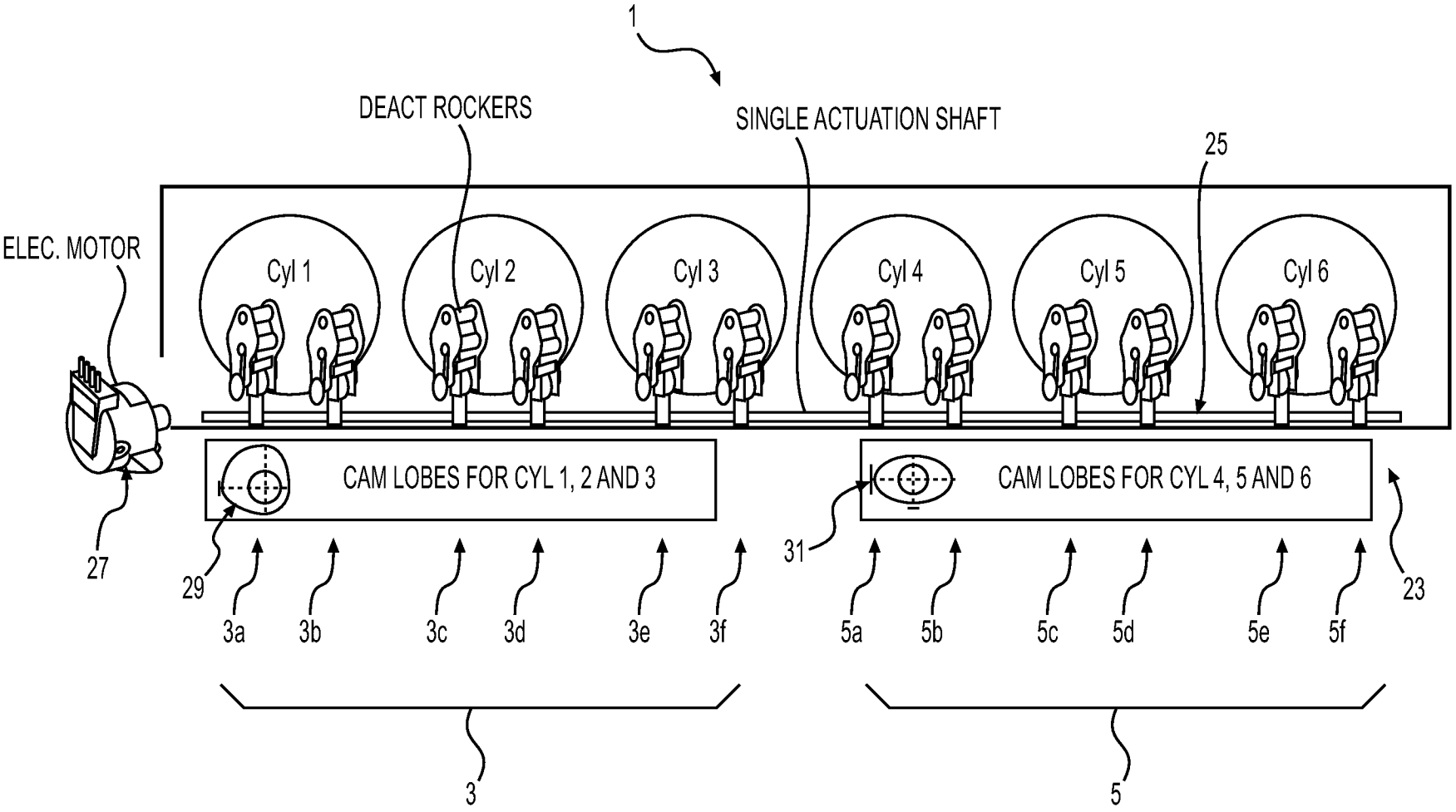
FIG. 5*c* illustrates schematically an arrangement of a valve train assembly according to an example.

FIG. 5*c* illustrates schematically a valve train assembly 1 comprising an actuation arrangement 23 as described above with reference to FIGS. 4*a* to 4*f* and/or 5*a* and 5*b*, as implemented in a six cylinder engine, according to an example.

Referring to FIG. 5*c*, the valve train assembly 1 comprises a first group 3 of dual body rocker arms 3*a*, 3*b*, 3*c*, 3*d*, 3*e*, 3*f* and a second group 5 of dual body rocker arms 5*a*, 5*b*, 5*c*, 5*d*, 53, 5*f*. Rocker arms 3*a* and 3*b* are for controlling respective valves of a first cylinder Cyl 1 of the engine, rocker arms 3*c* and 3*d* are for controlling respective valves of a second cylinder Cyl 2 of the engine, rocker arms 3*e* and 3*f* are for controlling respective valves of a third cylinder Cyl 3 of the engine, rocker arms 5*a* and 5*b* are for controlling respective valves of a fourth cylinder Cyl 4 of the engine, rocker arms 5*c* and 5*d* are for controlling respective valves of a fifth cylinder Cyl 5 of the engine, and rocker arms 5*e* and 5*f* are for controlling respective valves of a sixth cylinder Cyl 6 of the engine. In this example the valves are each exhaust valves. In this example the first to sixth cylinders are arranged in consecutive order, for example arranged in a substantially straight line, with the first cylinder being adjacent to the second cylinder, the second cylinder being adjacent to the first cylinder and the third cylinder, the third cylinder being adjacent to the second cylinder and the fourth cylinder, and so on. The cylinders Cyl 1, Cyl 2, Cyl 3 controlled by the first group 3 are consecutive to the cylinders Cyl 4, Cyl 5, Cyl 6 controlled by the second group 5.

The actuation arrangement 23 comprises a shaft 25 driven (rotatable) by an actuation source 27 as described above. The shaft 25 has mounted thereon selector cams 29, 31. There are six first selector cams 29 aligned along the length of the shaft 25 for contacting the dual body rocker arms 3*a*, 3*b*, 3*c*, 3*d*, 3*e*, 3*f* of the first group 3 in order to move the respective latch pins 15 of the dual body rocker arms 3*a*, 3*b*, 3*c*, 3*d*, 3*e*, 3*f* of the first group 3 from the unlatched position to the latched position, for example as described above. There are six second selector cams 31 aligned along the length of the shaft 25 for contacting the dual body rocker arms 5*a*, 5*b*, 5*c*, 5*d*, 5*e*, 5*f* of the second group 3 in order to move the respective latch pins 15 of the dual body rocker arms 5*a*, 5*b*, 5*c*, 5*d*, 5*e*, 5*f* of the second group 5 from the unlatched position to the latched position, for example as described above.

By controlling the actuation source 27 to rotationally orient the shaft 25, for example as described above with reference to FIG. 5*b*, control of the deactivation of none, all, or only the first to third of the six cylinders can be achieved. Accordingly, efficient control of whether all, none, or only a portion of the cylinders of the engine are active can be achieved. This is achieved by a single, common actuation shaft 25 controlled by a single, common actuation source 27, and hence is space and control efficient.

It will be appreciated that although six cylinders are illustrated in FIG. 5*c*, this need not necessarily be the case and that there may be a different number of cylinders. For example there may be four cylinders. In some examples, all exhaust valves and hence cylinders of an engine may be de-actuated (deactivated) at the same time. In some examples, only a proportion of the exhaust valves 40 (and hence cylinders) of an engine may be de-actuated (deactivated) at the same time. For example, as above, 50% of the exhaust valves 40 may be de-actuated (deactivated) at the same time (i.e. in common). However, other proportions may be activated/deactivated at the same time, for example, in a six cylinder engine, ⅓ or ⅔ of the exhaust valves may be activated/deactivated at the same time (i.e. in common).

It will be appreciated that in some examples selector cam shapes other than those described above with reference to FIGS. 5*a* to 5*c* may be used provide the control of the rocker arms. It will also be appreciated that although all of the rocker arms illustrated in FIG. 5*c* are controllable for cylinder deactivation this need not necessarily be the case and in other examples the engine may comprise rocker arms which are not controllable as described above. It will therefore be appreciated that in some examples the valve train assembly 1 may comprise a first group 3 of one or more dual body rocker arms for controlling one or more valves of a first cylinder, and a second group 5 of one or more dual body rocker arms for controlling one or more valves of a second cylinder, and an actuator arrangement 23 external to the dual body rocker arms for controlling the latching arrangement and wherein the actuator arrangement 23 comprises a shaft 25 comprising a first set of one or more cams 29 for controlling the latching arrangements 13 of the first group 3 of one or more dual body rocker arms and a second set of one or more cams 31 for controlling the latching arrangements 13 of the second group 5 of one or more dual body rocker arms, and wherein the shapes of the cams 29 of the first set of one or more cams is different to the shapes of the cams 31 of the second set of one or more cams to provide for controlling the latching arrangements on a per cylinder basis.

It will be appreciated that the first group and/or the second group may further comprise one or more dual body rocker arms for controlling one or more said valves of one or more further cylinders, and that there may in principle be any number of further cylinders, for example one, two, three, four, or more.

Although in the example of FIG. 5*c* the cylinders associated with the first group are consecutive to the cylinders associated with the second group, this need not necessarily be the case and in other examples the cylinders associated with the first group (or equally the second group) may not be adjacent to one another. For example, in an example where there are four cylinders, the first and third cylinders may be associated with the first group and the second and fourth cylinders may be associated with the second group. This may apply equally to where there are six cylinders in total, for example.

Although in the above the dual body rocker arms were described as providing a first primary function of a standard valve opening event and a second secondary function of cylinder deactivation, this need not necessarily be the case, and in other example, other functions or modes of operation may be provided by the dual body rocker arms. Indeed, the dual body rocker arms may be any dual body rocker arm for controlling a valve of a cylinder, the rocker arm comprising a first body, a second body mounted for pivotal motion with respect to the first body, and a latch pin moveable between a first position in which the latch pin latches the first body and the second body together and a second position in which the first body and the second body are un-latched to allow pivotal motion of the second body relative to the first body. For example, in some examples the slider pads 19 may be replaced by cam followers and the second cam profiles 45 may include a lift profile, such that the rocker arm may provide for a first valve lift mode when the latch pin is in the latched position and a second valve lift mode when the latch pin is in the unlatched position. In such a way, for example, other functionality such as, for example, internal Exhaust Gas Recirculation (iEGR) may be provided.

Although in some of the above examples the default position of the latch pin 15 was described as unlatched and that the latch pin 15 is actuated from an unlatched position to a latched position, this need not necessarily be the case and in some examples, the default position of the latch pin 15 may be latched, and the actuation arrangement 23 may be arranged to cause the latch pin to move from the latched position to the unlatched position. Indeed, the actuating arrangement may be arranged to move the respective latch pins of one or more dual body rocker arms from one of the latched and unlatched positions to the other of the latched and unlatched positions.

It is to be understood that any feature described in relation to any one example may be used alone, or in combination with other features described, and may also be used in combination with one or more features of any other of the examples, or any combination of any other of the examples.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A valve train assembly for an internal combustion engine, the valve train assembly comprising:

a rocker arm configured to control a valve of a cylinder, the rocker arm configured to switch between a latched state and an unlatched state, the rocker arm comprising an inner body, a latch pin and a first biasing means biasing the latch pin to configure the rocker arm in the unlatched state, wherein, in the latched state of the rocker arm, a valve end of the rocker arm periodically engages the valve based on a valve lift profile of a main cam, and wherein, in the unlatched state of the rocker arm, the inner body is configured to pivot such that the valve is prevented from opening during a full rotation of the main cam, the valve lift profile of the main cam absorbed by an inner body biasing member provided at a latch end of the rocker arm opposite the valve end; and an actuator arrangement external to the rocker arm and drivable by an actuator, the actuator arrangement configured to selectively rotate a selector cam to act on the latch pin, the selector cam being movable to select among three positions, wherein the three positions comprise either:

abutting one of two base circle portions configured for the latch pin to be in the unlatched state and abutting one lobed portion configured to move the latch pin from the unlatched state to the latched state, or abutting one of two lobed portions configured to move the latch pin from the unlatched state to the latched state and abutting one base circle portion configured for the latch pin to be in the unlatched state.

2. The valve train assembly of claim 1, further comprising a second biasing means configured to be preloaded by the one lobed portion or by the one of the two lobed portions.

3. The valve train assembly of claim 1, wherein the first biasing means is configured to be preloaded when the one of the two base circle portions abut the latch pin or when the one base circle portion abuts the latch pin.

4. The valve train assembly of claim 1, further comprising a second biasing means configured to bias the latch pin towards the unlatched state.

5. The valve train assembly of claim 1, wherein the first biasing means comprises a leaf spring.

6. The valve train assembly of claim 5, wherein a first end of the leaf spring is attached to the latch pin.

7. The valve train assembly of claim 5, wherein a second end of the leaf spring is configured to contact the actuator arrangement.

8. The valve train assembly of claim 5, wherein the leaf spring is external of the rocker arm.

9. The valve train assembly of claim 5, wherein the actuator arrangement comprises a shaft rotatable by the actuator, and wherein the shaft is rotatable to move the selector cam to select among the three positions.

10. The valve train assembly of claim 9, wherein the selector cam comprises the one lobed portion or the one of the two lobed portions for contacting the leaf spring.

11. The valve train assembly of claim 10, wherein the leaf spring is configured to preload the leaf spring to move the latch pin.

12. The valve train assembly of claim 1, further comprising a hydraulic fluid supply configured to supply hydraulic fluid to the latch pin to configure the rocker arm in the latched state.

13. The valve train assembly of claim 12, wherein the hydraulic fluid supply comprises a conduit through a hydraulic lash adjuster.

14. A valve train assembly, comprising:

a first group of one or more rocker arms and a second group of one or more rocker arms, each of the first group of one or more rocker arms and each of the second group of one or more rocker arms comprising a respective latch pin and a respective first biasing means biasing the respective latch pin to an unlatched state, wherein the first group of one or more rocker arms is configured to control one or more first valves of a first cylinder and the second group of one or more rocker arms is configured to control one or more second valves of a second cylinder, wherein each of the first group of one or more rocker arms and each of the second group of one or more rocker arms is configured to switch between a latched state and the unlatched state, wherein the first group of one or more rocker arms comprises one or more further first rocker arms configured to control one or more additional first valves of a third cylinder, wherein the second group of one or more rocker arms comprises one or more further second rocker arms configured to control one or more further second valves of a fourth cylinder, wherein the valve train assembly is configured such that the first and third cylinders are controlled by the first group of one or more rocker arms, and the first and third cylinders are consecutive to the second and fourth cylinders controlled by the second group of one or more rocker arms; and an actuator arrangement drivable by an actuator, the actuator arrangement comprising:

a respective first selector cam for each of the first group of one or more rocker arms, each of the first selector cams being movable to select among first sector positions, wherein the first sector positions comprise:

abutting one of two first base circle portions against a respective latch pin to maintain the first group of one or more rocker arms in the unlatched state; and abutting a first lobed portion against the respective latch pin to maintain the first group of one or more rocker arms in the latched state; and a respective second selector cam for each of the second group of one or more rocker arms, each of the second selector cams being movable to select among second sector positions, wherein the second sector positions comprise:

abutting one of two second lobed portions against a respective latch pin to maintain the second group of one or more rocker arms in the latched state; and abutting a second base circle portion against the respective latch pin to maintain the second group of one or more rocker arms in the unlatched state.

15. The valve train assembly of claim 14, further comprising a hydraulic fluid supply configured to supply hydraulic fluid to the respective latch pins.

16. The valve train assembly of claim 15, wherein the valve train assembly further comprises a plurality of hydraulic lash adjusters connected respectively to each of the first group of one or more rocker arms and to each of the second group of one or more rocker arms.

17. The valve train assembly of claim 15, wherein hydraulic fluid from the hydraulic fluid supply moves the respective latch pin from the unlatched state to the latched state in a motion that opposes the first biasing means.

18. The valve train assembly of claim 14, further comprising:

a first hydraulic fluid supply configured to supply first hydraulic fluid to the respective latch pins of the first group of one or more rocker arms; and a second hydraulic fluid supply configured to supply second hydraulic fluid to the respective latch pins of the second group of one or more rocker arms.

19. The valve train assembly of claim 18, wherein the first hydraulic fluid supply is controllable independently of the second hydraulic fluid supply.

20. The valve train assembly of claim 18, further comprising a first hydraulic fluid control valve to control the supply of hydraulic fluid in the first hydraulic fluid supply and a second hydraulic fluid control valve to control the supply of hydraulic fluid in the second hydraulic fluid supply.

21. The valve train assembly according to claim 20, further comprising a controller configured to control the first hydraulic fluid control valve and the second hydraulic fluid control valve.

22. The valve train assembly of claim 21, wherein the controller is configured to control the first and second hydraulic fluid control valves so as to supply hydraulic fluid to both, one of, or neither of the first and second hydraulic fluid supplies.

23. The valve train assembly of claim 14, wherein each respective first biasing means is located internally of the respective first group of one or more rocker arms and the respective second group of one or more rocker arms.

24. The valve train assembly of claim 14, wherein each respective first biasing means is located externally of the respective first group of one or more rocker arms and of the respective second group of one or more rocker arms.

25. The valve train assembly of claim 24, further comprising a respective second biasing means configured to preload each of the first group of one or more rocker arms and each of the second group of one or more rocker arms.

26. The valve train assembly of claim 14, wherein each first group of one or more rocker arms and each second group of one or more rocker arms comprise a respective roller for engaging a respective cam profile.

27. The valve train assembly of claim 14, wherein each first group of one or more rocker arms and each second group of one or more rocker arms are configured such that, when the respective latch pin is in the unlatched state, cylinder deactivation is provided.

28. The valve train assembly of claim 14, wherein the first group of one or more rocker arms comprises at least two first rocker arms each configured to control respective first valves of the first cylinder, and wherein the second group of one or more rocker arms comprises at least two second rocker arms each configured to control respective second valves of the second cylinder.

29. The valve train assembly of claim 14, wherein the first group of one or more rocker arms further comprises additional first rocker arms configured to control one or more first valves of one or more further first cylinders, and wherein the second group of one or more rocker arms further comprises additional second rocker arms configured to control one or more second valves of one or more further second cylinders.

30. The valve train assembly of claim 29, wherein the additional first rocker arms of the first group of one or more rocker arms are configured to control one half, one third, or two thirds of valves of a total number of cylinders in the valve train.

31. The valve train assembly of claim 14, wherein the first group of one or more rocker arms comprises one or more respective further first rocker arms configured to control one or more additional respective first valves of a fifth cylinder, and wherein the second group of one or more rocker arms comprises one or more respective further second rocker arms configured to control one or more additional respective second valves of a sixth cylinder.

32. The valve train assembly of claim 31, configured such that the first, third, and fifth cylinders are controlled by the first group of one or more rocker arms, and first, third, and fifth cylinders are consecutive to the second, fourth, and sixth cylinders controlled by the second group of one or more rocker arms.

33. The valve train assembly of claim 14, wherein the one or more first valves and the one or more second valves comprise exhaust valves.

* * * * *